US009562208B2

(12) United States Patent
DeSantis et al.

(10) Patent No.: US 9,562,208 B2
(45) Date of Patent: Feb. 7, 2017

(54) SULFONATE ESTERS TO IMPROVE FLUOROPOLYMER SEAL COMPATIBILITY OF LUBRICANT COMPOSITIONS

(71) Applicant: BASF SE

(72) Inventors: Kevin DeSantis, Upper Nyack, NY (US); Michael Hoey, Maplewood, NJ (US); Alfred Karl Jung, Carmel, NY (US); Stephen Ray Jones, Pomona, NY (US); Eugene Scanlon, Mamaroneck, NY (US); Philippe Rabbat, Maplewood, NJ (US)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/790,699

(22) Filed: Jul. 2, 2015

(65) Prior Publication Data

US 2016/0002560 A1 Jan. 7, 2016

Related U.S. Application Data

(60) Provisional application No. 62/020,017, filed on Jul. 2, 2014.

(51) Int. Cl.
*C10M 135/10* (2006.01)
*C10M 141/08* (2006.01)

(52) U.S. Cl.
CPC ..... *C10M 141/08* (2013.01); *C10M 135/10* (2013.01); *C10M 2203/1006* (2013.01); *C10M 2207/026* (2013.01); *C10M 2215/02* (2013.01); *C10M 2215/064* (2013.01); *C10M 2215/221* (2013.01); *C10M 2219/044* (2013.01); *C10M 2223/045* (2013.01); *C10N 2210/02* (2013.01); *C10N 2230/36* (2013.01); *C10N 2230/45* (2013.01); *C10N 2230/52* (2013.01); *C10N 2240/10* (2013.01)

(58) Field of Classification Search
CPC ..... C10M 135/10; C10M 2219/044
See application file for complete search history.

(56) References Cited

U.S. PATENT DOCUMENTS

| | | | | |
|---|---|---|---|---|
| 3,898,168 | A | 8/1975 | Brehm | |
| 4,764,296 | A | 8/1988 | Kennedy | |
| 5,204,011 | A * | 4/1993 | Nader | C10M 135/10 508/403 |
| 5,273,669 | A | 12/1993 | Schumacher et al. | |
| 5,547,593 | A | 8/1996 | Sanechika et al. | |
| 5,750,640 | A | 5/1998 | Scott et al. | |
| 5,804,537 | A | 9/1998 | Boffa et al. | |
| 8,084,404 | B2 | 12/2011 | Tobias et al. | |
| 8,586,771 | B1 | 11/2013 | Lutz et al. | |
| 2008/0051306 | A1 * | 2/2008 | Chasan | C10M 133/40 508/267 |
| 2009/0016652 | A1 | 1/2009 | Endo et al. | |
| 2013/0267450 | A1 | 10/2013 | Patil et al. | |
| 2014/0113844 | A1 | 4/2014 | Haque et al. | |
| 2014/0142009 | A1 | 5/2014 | DeSantis et al. | |

FOREIGN PATENT DOCUMENTS

| | | | |
|---|---|---|---|
| JP | 58015592 | A * | 1/1983 |
| JP | 2010-180278 | A | 8/2010 |
| WO | WO 2014/028629 | A1 | 2/2014 |

OTHER PUBLICATIONS

International Search Report for Application No. PCT/US2015/039061 dated Sep. 22, 2015, 3 pages.
Rudnick, Leslie R., "Lubricant Additives: Chemistry and Applications", 2nd Edition, p. 125, 2009.

* cited by examiner

*Primary Examiner* — Taiwo Oladapo
(74) *Attorney, Agent, or Firm* — Howard & Howard Attorneys PLLC

(57) ABSTRACT

This disclosure is directed to a lubricant composition having improved compatibility with fluoropolymer seals. The lubricant composition includes a base oil and a sulfonate ester. The disclosure is also directed to an additive package for a lubricant composition that provides improved compatibility with fluoropolymer seals. The additive package includes the sulfonate ester. The disclosure is also directed to a method of improving compatibility of a lubricant composition with a fluoropolymer seal disposed in an internal combustion engine. The sulfonate ester improves the compatibility with fluoropolymer seals of the resultant lubricant composition.

15 Claims, No Drawings

SULFONATE ESTERS TO IMPROVE FLUOROPOLYMER SEAL COMPATIBILITY OF LUBRICANT COMPOSITIONS

CROSS-REFERENCE TO RELATED APPLICATIONS

This application claims priority to U.S. Provisional Patent Application No. 62/020,017, filed on Jul. 2, 2014, which is hereby incorporated by reference.

FIELD OF THE INVENTION

The present invention generally relates to a sulfonate ester for a lubricant composition. More specifically, the invention relates to an additive package including a sulfonate ester, to a lubricant composition including a sulfonate ester, a method of lubricating a system including a fluoropolymer seal with the lubricant composition, and a method of using a sulfonate ester to improve the fluoropolymer seal compatibility of a lubricant composition.

BACKGROUND OF THE INVENTION

It is an object of the present invention to provide additives or combinations of additives that improve the fluoropolymer seal compatibility or other properties of lubricant compositions.

SUMMARY OF THE INVENTION

The present invention provides a lubricant composition having improved compatibility with fluoropolymer seals. The lubricant composition includes a base oil and a sulfonate ester.

The present invention also provides an additive package for a lubricant composition that provides improved compatibility with fluoropolymer seals. The additive package includes the sulfonate ester.

The present invention also provides a method of improving compatibility of the lubricant composition with a fluoropolymer seal disposed in an internal combustion engine.

Lubricant compositions including the sulfonate ester demonstrate improved compatibility with fluoropolymer seals as demonstrated by CEC L-39-T96.

DETAILED DESCRIPTION OF THE INVENTION

An additive package for a lubricant composition includes a sulfonate ester. The additive package may be added to conventional lubricant compositions. Both the additive package and the resultant lubricant composition (upon addition of the additive package) are contemplated and described collectively in this disclosure.

The sulfonate ester creates a beneficial seal compatibility effect in lubricant compositions. In certain embodiments, the sulfonate ester in combination with one or more additional additives, such as an amine dispersant, an amine compound having a total base number of at least 80 mg KOH/g when tested according to ASTM D4739, and/or a phosphorous-containing anti-wear compound, exhibits a beneficial seal compatibility effect.

It should be understood that, in certain aspects, the sulfonate ester may take many forms, so long as the sulfonate ester includes a sulfonate group. For example, the sulfonate ester may refer to mono-sulfonate esters, di-sulfonate esters, tri-sulfonate esters, and sulfonate esters including four or more sulfonate groups. It is also contemplated that two or more different, or two or more of the same, sulfonate groups may be present in the same sulfonate ester. For example, the sulfonate ester may include at least one mesylate group and at least one tosylate group in the same molecule.

In one aspect, the sulfonate ester has the following general formula (I):

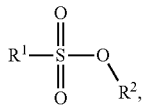

(I)

where $R^1$ and $R^2$ are each independently a hydrocarbyl group. Each hydrocarbyl group designated by $R^1$ and $R^2$ may independently be substituted or unsubstituted, straight or branched, alkyl, alkenyl, alkynyl, cycloalkyl, cycloalkenyl, aryl, alkylaryl, arylalkyl group, or combinations thereof. Each hydrocarbyl group designated by $R^1$ and $R^2$ may independently include from 1 to 100, 1 to 50, 1 to 40, 1 to 30, 1 to 20, 1 to 17, 1 to 15, 1 to 10, 1 to 6, or 1 to 4, carbon atoms. Alternatively, each hydrocarbyl group designated by $R^1$ and $R^2$ may independently include less than 20, less than 15, less than 12, or less than 10, carbon atoms.

In embodiments when the hydrocarbyl group of $R^2$ is substituted, the hydrocarbyl group of $R^2$ may be substituted with at least one functional group comprising oxygen, nitrogen, phosphorous, or sulfur atoms. In certain embodiments, when the hydrocarbyl group of $R^2$ is substituted with at least one functional group including an oxygen atom, the functional group is selected from the groups consisting of an ether group, an alcohol group, a carbonyl group, or a peroxide group. In other embodiments, when the hydrocarbyl group of $R^2$ is substituted with at least one functional group including an oxygen atom, the functional group consists of an ether group, an alcohol group, a carbonyl group, or a peroxide group.

In embodiments where the functional group of the hydrocarbyl group of $R^2$ includes the ether group, the functional group of the hydrocarbyl group of $R^2$ may include, but not be limited to, alkoxy groups or cyclic ethers, such as epoxides and butoxides. It is to be appreciated that other ether groups may be utilized as the functional group of the hydrocarbyl group of $R^2$.

In embodiments where the functional group of the hydrocarbyl group of $R^2$ includes the carbonyl group, the functional group of the hydrocarbyl group of $R^2$ may include, but not be limited to, ketones, aldehydes, or amides. It is to be appreciated that other carbonyl groups may be utilized as the functional group of the hydrocarbyl group of $R^2$.

Exemplary alkyl groups include methyl, ethyl, propyl, isopropyl, n-butyl, isobutyl, sec-butyl, tert-butyl, pentyl, iso-amyl, hexyl, 2-ethylhexyl, octyl, cetyl, 3,5,5-trimethylhexyl, 2,5,9-trimethyldecyl, and dodecyl groups. Exemplary cycloalkyl groups cyclopropyl, cyclopentyl and cyclohexyl groups. Exemplary aryl groups include phenyl and naphthalenyl groups. Exemplary arylalkyl groups include benzyl, phenylethyl, and (2-naphthyl)-methyl.

By "unsubstituted," it is intended that the designated hydrocarbyl group, $R^1$ or $R^2$ for example, is free from substituent functional groups, such as alkoxy, amide, amine, keto, hydroxyl, carboxyl, ester, oxide, thio, and/or thiol groups, and that the designated hydrocarbyl group or hydrocarbon group is free from heteroatoms and/or heterogroups.

In some embodiments, the sulfonate ester is free from, or includes a limited number of certain substituent groups. For example, the sulfonate ester may include fewer than three, fewer than two, one, or be completely free from, carbonyl groups. In other aspects, the sulfonate ester is free from an estolide groups (and is not an estolide). In still other aspects, the sulfonate ester is free from metal ions and/or other ions. In various aspects, the sulfonate ester is free of fluorine atoms.

In certain aspects, each hydrocarbyl group designated by $R^1$ and $R^2$ may be independently substituted, and include at least one heteroatom, such as oxygen, nitrogen, sulfur, chlorine, fluorine, bromine, or iodine, and/or at least one heterogroup, such as pyridyl, furyl, thienyl, and imidazolyl. Alternatively, or in addition to including heteroatoms and heterogroups, each hydrocarbyl group designated by $R^1$ may independently include at least one substituent group selected from alkoxy, amide, amine, carboxyl, epoxy, ester, ether, hydroxyl, keto, sulfonate, sulfuryl, and thiol groups. In certain embodiments, at least one hydrocarbyl group designated by $R^1$ independently includes piperidine. Alternatively, or in addition to including heteroatoms and heterogroups, each hydrocarbyl group designated by $R^2$ may independently include at least one substituent group selected from alkoxy, amide, amine, carboxyl, epoxy, ether, hydroxyl, keto, sulfonate, sulfuryl, and thiol groups. For example, each hydrocarbyl group designated by $R^1$ and $R^2$ may include a hydrocarbyl group that includes a sulfonate group. Alternatively still, at least one hydrocarbyl group designated by $R^1$ and $R^2$ may include a hydrocarbyl group that includes at least two sulfonate groups.

In certain embodiments, the sulfonate ester including two sulfonate ester groups is further defined as a bis(sulfonate ester). One non-limiting example of a bis(sulfonate ester) is (2,4-dimethyl-5-octylsulfonyloxy-pentyl) octane-1-sulfonate.

In one embodiment, the sulfonate ester of general formula (I) is cyclic, meaning that at least one group designated by $R^1$ and $R^2$ is cyclic, or that $R^1$ or $R^2$ include a pendant cyclic group. In other aspects, the sulfonate ester of general formula (I) is acyclic, meaning that both $R^1$ and $R^2$ are acyclic and that $R^1$ and $R^2$ are free from pendant cyclic groups. Alternatively still, with respect to general formula (I), $R^1$ is a methyl group and $R^2$ is a hydrocarbyl group having from 1 to 17 carbon atoms; $R^1$ is a methyl group and $R^2$ may be an alkyl group having from 1 to 17 carbon atoms; $R^1$ is a methylbenzyl group and $R^2$ is a hydrocarbyl group having from 1 to 17 carbon atoms; or $R^1$ is a methylbenzyl group and $R^2$ may be an alkyl group having from 1 to 17 carbon atoms.

Alternatively, as contemplated by general formula (I), $R^1$ is selected from a p-nitrobenzenesulfonate and a p-bromobenzenesulfonate, and $R^2$ is a hydrocarbyl group having from 1 to 17 carbon atoms.

In some aspects, the sulfonate ester is free from ionic bonds. In other words, the bonds present between the atoms of the sulfonate ester in this aspect consist solely of covalent bonds.

In various embodiments, the sulfonate ester is not a metal salt of an organic acid. Further, in certain embodiments, the sulfonate ester is not reacted with inorganic bases, such as metal oxides, metal hydroxides, and metal carbonates, to form a salt. As such, in these embodiments, the sulfonate ester is not a salt.

The sulfonate ester may have a weight average molecular weight ranging from 96 to 1500, 100 to 1000, 100 to 500, 150 to 500, or 250 to 400.

In some aspects, the sulfonate ester may include 1 to 50, 1 to 40, 5 to 30, 5 to 25, or 10 to 25, mole % sulfur, based on the total number of moles in the sulfonate ester.

By way of example, the sulfonate esters encompassed by general formula (I) and the above description may be exemplified by one or more of the following compounds:

Cetyl Mesylate

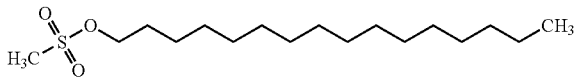

3,5,5-Trimethylhexyl Methanesulfonate

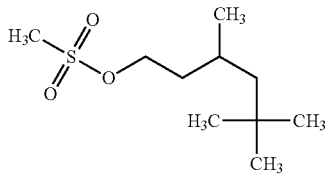

2,5,9-Trimethyldecyl Methanesulfonate

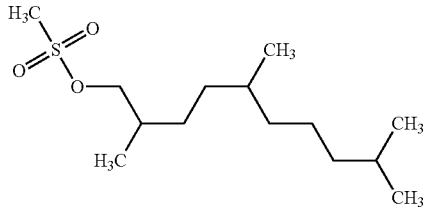

(2,4-Dimethyl-5-octylsulfonyloxy-pentyl) octane-1-sulfonate

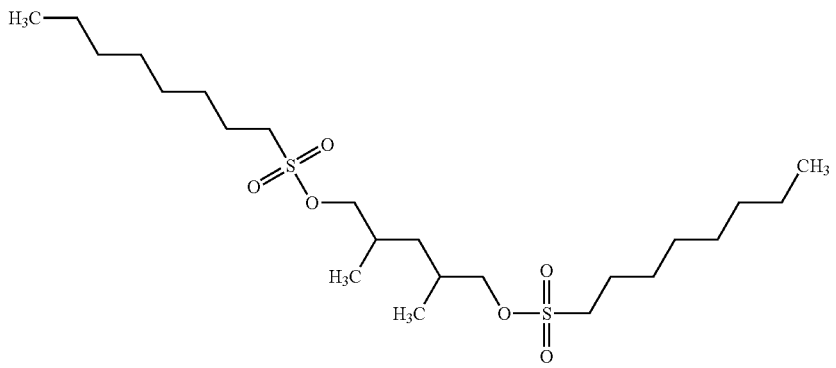

Hexyl 4-Methylbenezene Sulfonate

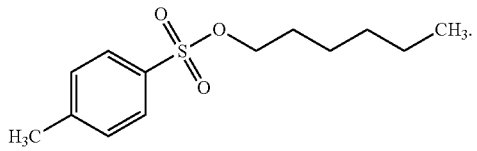

The sulfonate ester may be synthesized in a variety of ways. For example, the sulfonate may be formed by alcoholysis of sulfonyl chlorides by the following reaction mechanism:

$$R^1SO_2Cl+R^2OH \rightarrow R^1SO_2OR^2+HCl,$$

where $R^1$ and $R^2$ are each independently hydrocarbyl groups as described above in general formula (I). However, it should be appreciated that other methods of synthesizing the sulfonate ester are also contemplated.

In the context of the additive package, the sulfonate ester can be present in an amount ranging from 0.1 to 100, 5 to 50, or 10 to 40, wt. %, based on the total weight of the additive package. In the context of a lubricant composition, the sulfonate ester can be present in an amount ranging from 0.01 to 10, 0.05 to 5, 0.1 to 3, 0.1 to 2, or 0.3 to 1.5, wt. %, based on the total weight of the lubricant composition. The additive package or lubricant composition may include mixtures of two or more different sulfonate esters. For example, the additive package and/or the lubricant composition may include a mixture of cetyl mesylate, 3,5,5-trimethylhexyl methanesulfonate, and 2,5,9-trimethyldecyl methanesulfonate.

In certain embodiments, the sulfonate ester contributes less than 0.35 wt. %, less than 0.3 wt. %, less than 0.25 wt. %, less than 0.2 wt. %, less than 0.15 wt. %, or less than 0.1, wt % of sulfated ash, based on a total weight of the lubricant composition, to the lubricant composition when tested according to ASTM D874.

In various embodiments, the sulfonate ester contributes less than 5, less than 4, less than 3, less than 2, or less than 1, mg KOH/g of the lubricant composition, to a total base number (TBN) of the lubricant composition when tested according to ASTM D4739 when the sulfonate ester is included in an amount of 1.5 wt. %, based on a total weight of the lubricant composition.

In certain embodiments, at least 50, at least 60, at least 70, at least 80 or, at least 90, wt. %, of the sulfonate ester remains unreacted in the additive package and/or lubricant composition based on the total weight of sulfonate ester utilized to form the additive package and/or the lubricant composition prior to any reaction in the additive package or the lubricant composition. Alternatively, at least 95, at least 96, at least 97, at least 98, or at least 99, wt. %, of the sulfonate ester remains unreacted in the additive package and/or the lubricant composition based on the total weight of the sulfonate ester prior to any reaction in the additive package or the lubricant composition.

The term "unreacted" refers to the fact that the unreacted amount of the sulfonate ester does not react with any components in the additive package or lubricant composition. Accordingly, the unreacted portion of the sulfonate ester remains in its virgin state when present in the additive package or the lubricant composition before the lubricant composition has been used in an end-use application, such as an internal combustion engine.

The phrase "prior to any reaction" refers to the basis of the amount of the sulfonate ester in the additive package or lubricant composition. This phrase does not require that the sulfonate ester reacts with other components in the additive package or the lubricant composition, i.e., 100 wt. % of the sulfonate ester may remain unreacted in the additive package and/or the lubricant composition based on the total weight of the sulfonate ester prior to any reaction in the additive package and/or the lubricant composition.

In one embodiment, the percentage of the sulfonate ester that remains unreacted is determined after all of the components which are present in the additive package or lubricant composition reach equilibrium with one another. The time period necessary to reach equilibrium in the additive package or lubricant composition may vary widely. For example, the amount of time necessary to reach equilibrium may range from a single minute to many days, or even weeks. In certain embodiments, the percentage of the sulfonate ester that remains unreacted in the additive package or lubricant composition is determined after 1 minute, 1 hour, 5 hours, 12 hours, 1 day, 2 days, 3 days, 1 week, 1 month, 6 months, or 1 year.

In some embodiments, in contrast to the sulfonate ester of the present invention, conventional lubricant additives undergo tribopolymerization in lubricant compositions to form protective lubricating films. In the tribopolymerization process, polymer-formers are adsorbed on a solid surface and polymerize under rubbing conditions to form organic polymeric films directly on the rubbing surface. In such conventional uses, more than 50 wt. % of the conventional lubricant additives may be reacted via tribopolymerization. In contrast, the lubricant compositions of this invention may contain a significant amount of the sulfonate ester that does not react via tribopolymerization. In certain embodiments, at least 50, 60, 70, 80, or 90, wt. %, of the sulfonate ester does not react via tribopolymerization in the lubricant composition at a temperature less than 100, 80, or 60, ° C., based on the total weight of the sulfonate ester utilized to form the lubricant composition. Alternatively, at least 95, 96, 97, 98, or 99, wt. %, of the sulfonate ester does not react via tribopolymerization in the lubricant composition at a temperature less than 100, 80, or 60, ° C., based on a total weight of the sulfonate ester in the lubricant composition.

The sulfonate ester may be combined with an amine compound in the lubricant composition or additive package. It should be appreciated that mixtures of different amine compounds may also be combined with the sulfonate ester in the lubricant composition and/or additive package.

The amine compound may take many forms so long as the amine compound includes at least one nitrogen atom. Furthermore, in some configurations, the amine compound does not include triazoles, triazines, or similar compounds where there are three or more nitrogen atoms in the body of a cyclic ring. The amine compound may be aliphatic.

In certain embodiments, the amine compound has a total base number (TBN) value of at least 10 mg KOH/g when tested according to ASTM D4739. Alternatively, the amine compound has a TBN value of at least 15, at least 20, at least 25, at least 30, at least 40, and least 50, at least 60, at least 70, at least 80, at least 90, at least 100, at least 110, at least 120, at least 130, at least 140, at least 150, or at least 160, mg KOH/g, when tested according to ASTM D4739. Alternatively still, the amine compound may have a TBN value of from 80 to 600, 90 to 500, 100 to 300, or 100 to 200, mg KOH/g, when tested according to ASTM D4739.

In some embodiments, the amine compound does not negatively affect the TBN of the lubricant compositions. Alternatively, the amine compound may improve the TBN of the lubricant composition by, at least 0.5, at least 1, at least 1.5, at least 2, at least 2.5, at least 3, at least 3.5, at least 4, at least 4.5, at least 5, at least 10, or at least 15, mg KOH/g of the amine compound. The TBN value of the lubricant composition can be determined according to ASTM D2896.

In some embodiments, the amine compound consists of, or consists essentially of, hydrogen, carbon, nitrogen, and oxygen. Alternatively, the amine compound may consist of, or consist essentially of, hydrogen, carbon, and nitrogen. In the context of the amine compound, the phrase "consist essentially of" refers to compounds where at least 95 mole % of the amine compound are the recited atoms (i.e., hydrogen, carbon, nitrogen, and oxygen; or hydrogen, carbon, and nitrogen). For example, if the amine compound consists essentially of hydrogen, carbon, nitrogen, and oxygen, at least 95 mole % of the amine compound is hydrogen, carbon, nitrogen, and oxygen. In certain configurations, at least 96, at least 97, at least 98, at least 99, or at least 99.9, mole %, of the amine compound are hydrogen, carbon, nitrogen and oxygen, or, in other embodiments, are carbon, nitrogen, and hydrogen.

The amine compound may consist of covalent bonds. The phrase "consist of covalent bonds" is intended to exclude those compounds which bond to the amine compound through an ionic association with at least one ionic atom or compound. That is, in configurations where the amine compound consists of covalent bonds, the amine compound excludes salts of amine compounds, for example, phosphate amine salts and ammonium salts. As such, in certain embodiments, the lubricant composition is free of a salt of the amine compound. For example, the lubricant compositions may be free of a phosphate amine salt, ammonium salt, and/or amine sulfate salt.

The amine compound may be an acyclic amine compound, such as an acyclic amine compound having a weight average molecular weight of less than 500. Alternatively, the acyclic amine compound may have a weight average molecular weight of less than 450, less than 400, less than 350, less than 300, less than 250, less than 200, or less than 150. Alternatively still, the amine compound may have a weight average molecular weight of at least 30, at least 50, at least 75, at least 100, at least 150, at least 200, or at least 250.

The term "acyclic" is intended to refer to amine compounds which are free from any cyclic structures and is intended to exclude aromatic structures. For example, the acyclic amine compound does not include compounds having a ring having at least three atoms bonded together in a cyclic structure and those compounds including benzyl, phenyl, or triazole groups.

The acyclic amine compound may be exemplified by general formula (II):

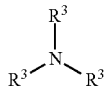

(II)

where each $R^3$ is independently a hydrogen atom or a hydrocarbyl group. Each hydrocarbyl group designated by $R^3$ may independently be substituted or unsubstituted, straight or branched, alkyl, alkenyl, cycloalkyl, cycloalkenyl, aryl, alkylaryl, arylalkyl group, or combinations thereof, as described above with respect to $R^1$ in general formula (I). Each hydrocarbyl group designated by $R^3$ may independently include from 1 to 100, 1 to 50, 1 to 40, 1 to 30, 1 to 20, 1 to 15, 1 to 10, 1 to 6, or 1 to 4, carbon atoms. Alternatively, each hydrocarbyl group designated by $R^3$ may independently include less than 20, less than 15, less than 12, or less than 10, carbon atoms.

The acyclic amine includes monoamines and polyamines (including two or more amine groups). In certain embodiments, at least one group designated by $R^3$ is unsubstituted. Alternatively, two or three groups designated by $R^3$ are unsubstituted. Alternatively still, it is contemplated that one, two, or three groups designated by $R^3$ are substituted.

Exemplary acyclic amine compounds include, but are not limited to, primary, secondary, and tertiary amines, such as:

Methylamine:

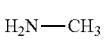

Ethanolamine:

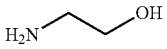

-continued

Dimethylamine:

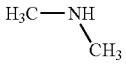

Methylethanolamine:

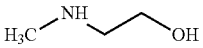

Trimethylamine:

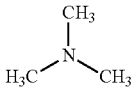

Bis (2-ethylhexyl) amine:

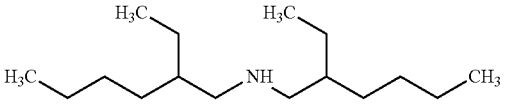

Ditridecylamine:

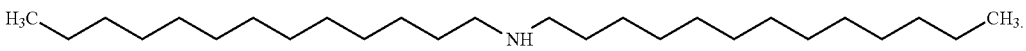

The acyclic amine compound may alternatively include at least one other primary amines such as ethylamine, n-propylamine, isopropylamine, n-butylamine, isobutylamine, sec-butylamine, tert-butylamine, pentylamine, and hexylamine; primary amines of the formulas: $CH_3—O—C_2H_4—NH_2$, $C_2H_5—O—C_2H_4—NH_2$, $CH_3—O—C_3H_6—NH_2$, $C_2H_5—O—C_3H_6—NH_2$, $C_4H_9—O—C_4H_8—NH_2$, $HO—C_2H_4—NH_2$, $HO—C_3H_6—NH_2$ and $HO—C_4H_8—NH_2$; secondary amines, for example diethylamine, methylethylamine, di-n-propylamine, diisopropylamine, diisobutylamine, di-sec-butylamine, di-tert-butylamine, dipentylamine, dihexylamine; and also secondary amines of the formulas: $(CH_3—O—C_2H_4)_2NH$, $(C_2H_5—O—C_2H_4)_2NH$, $(CH_3—O—C_3H_6)_2NH$, $(C_2H_5—O—C_3H_6)_2NH$, $(n\text{-}C_4H_9—O—C_4H_8)_2NH$, $(HO—C_2H_4)_2NH$, $(HO—C_3H_6)_2NH$ and $(HO—C_4H_8)_2NH$; and polyamines, such as n-propylenediamine, 1,4-butanediamine, 1,6-hexanediamine, diethylenetriamine, triethylenetetramine and tetraethylenepentamines, and also their alkylation products, for example 3-(dimethylamino)-n-propylamine, N,N-dimethylethylenediamine, N,N-diethylethylenediamine, and N,N,N',N'-tetramethyldiethylenetriamine.

Alternatively, the amine compound may be a cyclic amine compound, such as a monomeric cyclic amine compound. The cyclic amine compound may have a weight average molecular weight of from 100 to 1200, 200 to 800, or 200 to 600. Alternatively, the cyclic amine compound may have a weight average molecular weight of less than 500, or at least 50. In some embodiments, the cyclic amine compound is free from aromatic groups, such as phenyl and benzyl rings. In other embodiments, the cyclic amine compound is aliphatic.

The cyclic amine compound may include two or fewer nitrogen atoms per molecule. Alternatively, the cyclic amine compound may include only one nitrogen per molecule. The phrase "nitrogen per molecule" refers to the total number of nitrogen atoms in the entire molecule, including the body of the molecule and any substituent groups. In certain embodiments, the cyclic amine compound includes one or two nitrogen atoms in the cyclic ring of the cyclic amine compound.

The cyclic amine compound may be exemplified by the general formula (III):

(III)

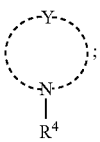

or general formula (IV):

(IV)

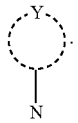

In general formulas (III) and (IV), Y represents the type and number of atoms necessary to complete the cyclic ring of general formulas (III) or (IV). The ring designated by Y may include from 2 to 20, 3 to 15, 5 to 15, or 5 to 10, carbon atoms. The ring designated by Y may be a substituted or unsubstituted, branched or unbranched, divalent hydrocarbon group that includes at least one hetero atom, such as oxygen, or sulfur, and may include at least one heterogroup. In addition to including heteroatoms and/or heterogroups, the ring designated by Y may include at least one hydrocarbyl substituent group. The ring designated by Y may further include a piperidine. In certain embodiments, the ring designated by Y is free from nitrogen heteroatoms, or free from any heteroatoms. The heteroatoms, heterogroups, and/or substituent groups may be bonded to different atoms in the divalent hydrocarbon group designated by Y.

In formula (III), $R^4$ is a hydrogen atom or a hydrocarbyl group. Each hydrocarbyl group designated by $R^4$ may independently be substituted or unsubstituted, straight or branched, alkyl, alkenyl, cycloalkyl, cycloalkenyl, aryl, alkylaryl, arylalkyl group, or combinations thereof. The hydrocarbyl group designated by $R^4$ may have the same meaning as $R^1$ described above with respect to general formula (I). For example, $R^4$ may be an alcohol group, an amino group, an alkyl group, an amide group, an ether group, or an ester group. $R^4$ may have 1 to 50, 1 to 25, 1 to 17, 1 to 15, 1 to 12, 1 to 8, 1 to 6, or 1 to 4, carbon atoms. $R^4$ may be straight or branched. For example, each $R^4$ may be an alcohol group, amino group, alkyl group, amide group, ether group, or ester group, each having 1 to 50 carbon atoms, with the designated functional group (alcohol, etc.), heteroatom, or heterogroup potentially bonded at various positions on the carbon atoms in the hydrocarbyl group. The substituent nitrogen atom in general formula (IV) may be bonded to at least one hydrogen atom, or may be bonded to one or two hydrocarbyl groups.

In one embodiment, the cyclic amine compound may be exemplified by general formula (V):

(V)

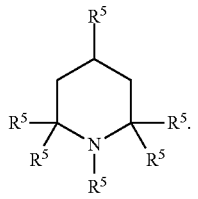

In general formula (V), each $R^5$ is independently a hydrogen atom or a hydrocarbyl group having from 1 to 17 carbon atoms. The hydrocarbyl group designated by $R^5$ may have the same meaning as $R^1$ in general formula (I). For example, each $R^5$ may independently be substituted with an alcohol group, an amino group, an amide group, an ether group, or an ester group. Each $R^5$ may independently have from 1 to 17, 1 to 15, 1 to 12, 1 to 8, 1 to 6, or 1 to 4, carbon atoms. In certain embodiments, at least one group designated by $R^5$ is unsubstituted. Alternatively, at least two, three, four, five, or six groups designated by $R^5$ are unsubstituted. Alternatively still, it is contemplated that one, two, three, four, five, or six groups designated by $R^5$ are substituted. For example, each $R^5$ may be an alcohol group, amino group, alkyl group, amide group, ether group, or ester group having 1 to 17 carbon atoms, with the designated functional group (alcohol, etc) bonded at various positions on the carbon chain.

Exemplarycyclic amine compounds include:

Cyclopentamine:

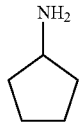

Cyclohexylamine:

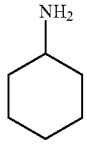

Aziridine:

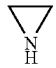

Piperidine:

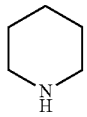

N-methylpiperidine:

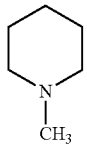

In some embodiments, the amine compound, such as the acyclic amine compound or the cyclic amine compound, may be a sterically hindered amine compound. The sterically hindered amine compound may have a weight average molecular weight of from 100 to 1200. Alternatively, the sterically hindered amine compound may have a weight average molecular weight of from 200 to 800, or 200 to 600. Alternatively still, the sterically hindered amine compound may have a weight average molecular weight of less than 500.

As used herein, the term "sterically hindered amine compound" means an organic molecule having fewer than two hydrogen atoms bonded to at least one alpha-carbon with reference to a secondary or tertiary nitrogen atom. In other embodiments, the term "sterically hindered amine compound" means an organic molecule having no hydrogen atoms bonded to at least one alpha-carbon with reference to a secondary or tertiary nitrogen atom. In still other embodiments, the term "sterically hindered amine compound" means an organic molecule having no hydrogen atoms bonded to each of at least two alpha-carbons with reference to a secondary or tertiary nitrogen atom.

The sterically hindered amine compound may have general formula (VI) or (VII):

(VI)

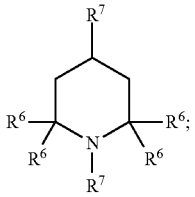

(VII)

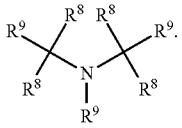

In general formula (VI), each $R^6$ is independently a hydrogen atom or a hydrocarbyl group having from 1 to 17 carbon atoms, where at least two groups designated by $R^6$ are an alkyl group; and each $R^7$ is independently a hydrogen atom or a hydrocarbyl group having from 1 to 17 carbon atoms. In general formula (VII), each $R^8$ is independently a hydrogen atom or a hydrocarbyl group having from 1 to 17 carbon atoms, where at least two of $R^8$ are an alkyl group, and each $R^9$ is independently a hydrogen atom or a hydrocarbyl group having from 1 to 17 carbon atoms.

The groups designated by $R^6$, $R^7$, $R^8$, and $R^9$ may have the same meaning as $R^1$ described above with respect to general formula (I). For example, each $R^6$, $R^7$, $R^8$, and $R^9$ may independently substituted with an alcohol group, an amino group, an amide group, an ether group, an ester group, or a piperidine, and each $R^6$, $R^7$, $R^8$, and $R^9$ may independently have from 1 to 17, 1 to 15, 1 to 12, 1 to 8, 1 to 6, or 1 to 4, carbon atoms.

In certain embodiments, at least one group designated by $R^6$, $R^7$, $R^8$, and $R^9$ is unsubstituted. Alternatively, at least two, three, four, five, or six groups designated by $R^6$, $R^7$, $R^8$, and $R^9$ are unsubstituted. In other embodiments, every group designated by $R^6$, $R^7$, $R^8$, and $R^9$ is unsubstituted. Alternatively still, it is contemplated that one, two, three, four, five, or six groups designated by $R^6$, $R^7$, $R^8$, and $R^9$ are substituted.

Exemplary $R^6$, $R^7$, $R^8$, and $R^9$ groups may be independently selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, or n-octadecyl.

In general formula (VI), at least two, at least three, or all four groups, designated by $R^6$ are each independently an alkyl group. Similarly, in general formula (VII), at least two groups designated by $R^8$ are an alkyl group. Alternatively, at least three, or all four groups, designated by $R^8$ are an alkyl group.

The sterically hindered amine compound of general formula (VI) may be exemplified by the following compounds:

2,2,6,6-Tetramethyl-4-octylpiperdine:

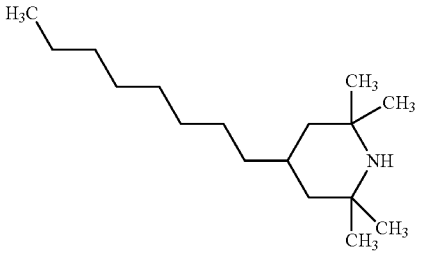

2,2,6,6-Tetramethyl-4-decylpiperdine:

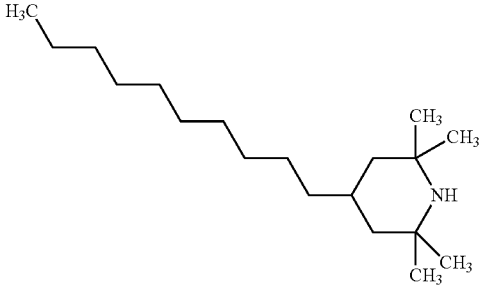

2,2,6,6-Tetramethyl-4-butylpiperdine:

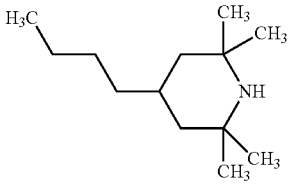

2,2,6,6-Tetramethyl-4-hexadecylpiperdine:

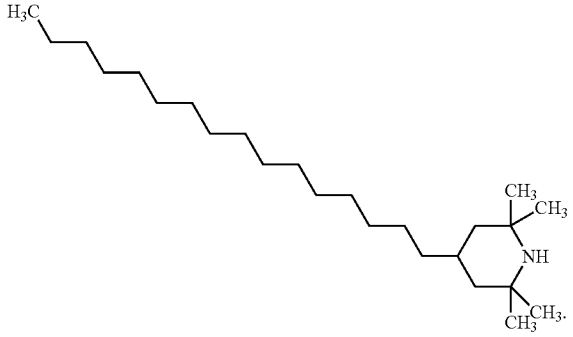

In some aspects, the sterically hindered amine compound of general formula (VII) is acyclic. The term "acyclic" is intended to mean that the sterically hindered amine compound of general formula (VII) is free from any cyclic structures and aromatic structures. In other aspects, at least one nitrogen atom in the sterically hindered amine compound of general formula (VII) is not part of a cyclic or aromatic ring.

The sterically hindered amine compound of general formula (VII) can be exemplified by:

N-tert-butyl-2-ethyl-N-methyl-hexan-1-amine:

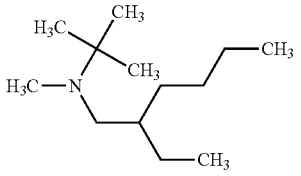

Tert-amyl-tert-butylamine:

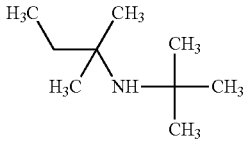

N-tert-butylheptan-2-amine:

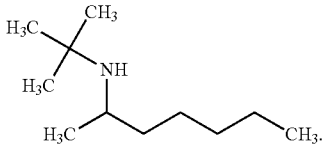

Tris(2-Ethylhexylamine):

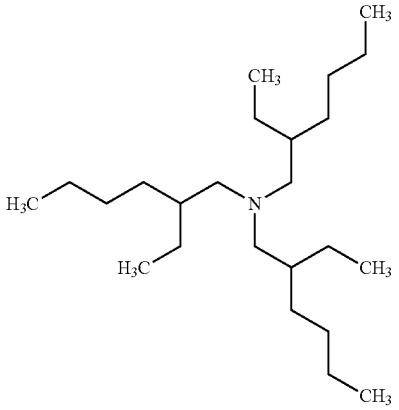

2-Ethyl-N,N-bis(2-ethylbutyl)hexan-1-amine:

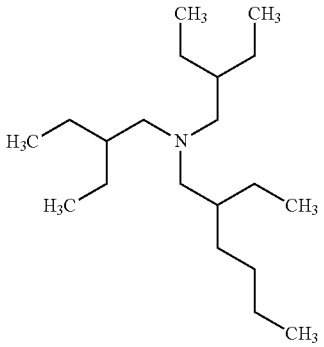

-continued

2-Ethyl-N-(2-ethylhexyl)-N-(2-methylpentyl)hexan-1-amine:

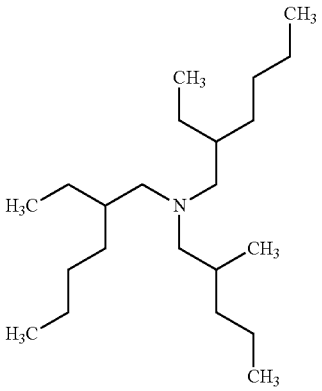

2-Ethyl-N-(2-ethylhexyl)-N-(4-methylpentan-2-yl)hexan-1-amine:

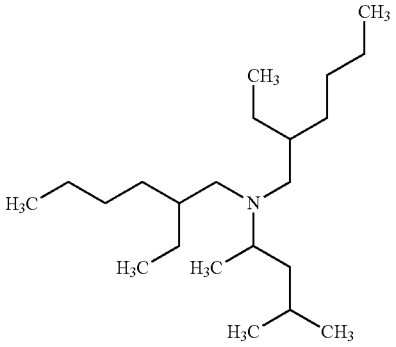

2-Ethyl-N-isobutyl-N-(4-methylpentan-2-yl)hexan-1-amine:

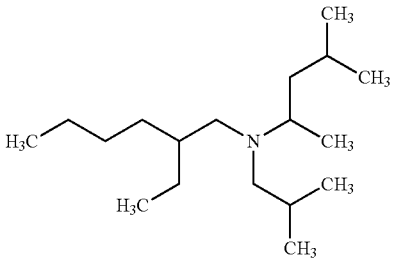

2-Ethyl-N-(2-ethylhexyl)-N-phenyethylhexan-1-amine:

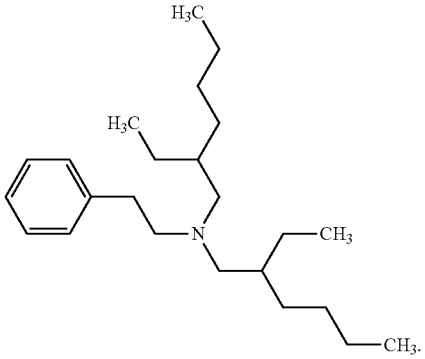

The sterically hindered amine compound may alternatively be exemplified by the general formula (VIII):

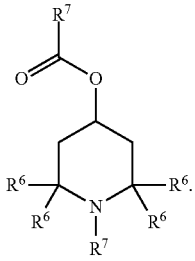

(VIII)

In general formula (VIII), each $R^6$ and $R^7$ are as described above, where at least three of $R^6$ are each independently an alkyl group. In certain embodiments, at least one of $R^7$ independently includes a piperidine. The sterically hindered amine compound of general formula (VIII) may be exemplified by the following compounds:

(1,2,2,6,6-pentamethyl-4-piperidyl) octanoate:

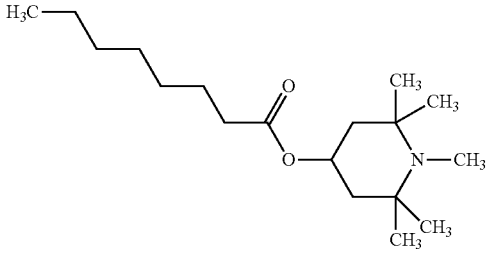

(1,2,2,6,6-pentamethyl-4-piperidyl) decanoate:

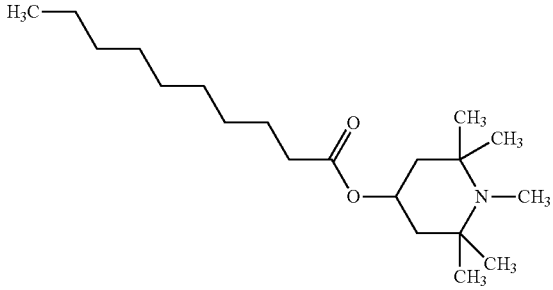

(1,2,2,6,6-Pentamethyl-4-piperidyl) dodecanoate:

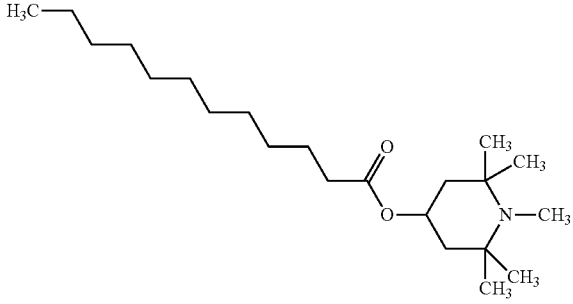

-continued (2,2,6,6-Tetramethyl-4-piperidyl) dodecanoate:

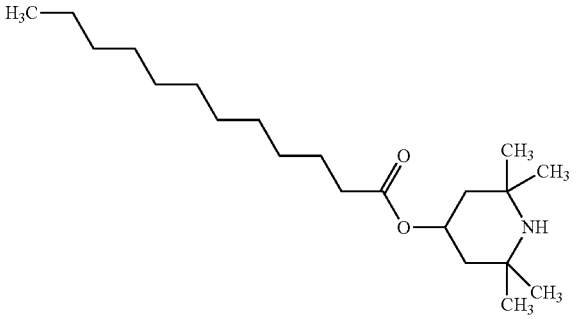

bis(1,2,2,6,6-pentamethyl-4-piperidyl) decanedioate:

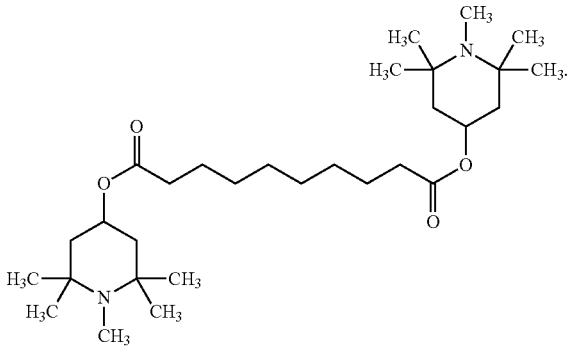

The sterically hindered amine compound may include a single ester group. However, the sterically hindered amine compound may alternatively be free from ester groups. In certain embodiments, the sterically hindered amine compound may include at least one, or only one, piperidine ring. In other embodiments, the sterically hindered amine compound may include two ester groups and two piperidine rings, and may be a bis-functional sterically hindered amine compound. In various embodiments, the sterically hindered amine compound may include greater than two ester groups.

The sterically hindered amine compound may alternatively be exemplified by the general formula (IX):

(IX)

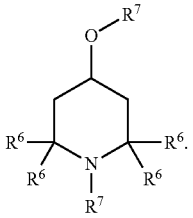

In general formula (IX), each $R^6$ and $R^7$ are as described above, where at least three of $R^6$ are each independently an alkyl group. In certain embodiments, at least one of $R^7$ independently includes a piperidine. The sterically hindered amine compound of general formula (IX) may be exemplified by the following compound:

4-dodecoxy-2,2,6,6,-tetramethyl-piperidine

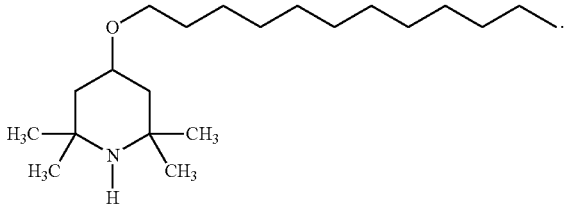

The sterically hindered amine compound may include a single ether group. However, the sterically hindered amine compound may alternatively be free from ether groups. In certain embodiments, the sterically hindered amine compound may include at least one, or only one, piperidine ring. In other embodiments, the sterically hindered amine compound may include two ether groups and two piperidine rings, and may be a bis-functional sterically hindered amine compound. In various embodiments, the sterically hindered amine compound may include greater than two ether groups.

The sterically hindered amine compound may alternatively be exemplified by the general formula (X):

(X)

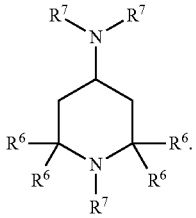

In general formula (X), each $R^6$ and $R^7$ are as described above, where at least three of $R^6$ are each independently an alkyl group. In certain embodiments, at least one of $R^7$ independently includes a piperidine. The sterically hindered amine compound of general formula (X) may be exemplified by the following compounds:

N-butyl-2,2,6,6-tetramethyl-piperidin-4-amine:

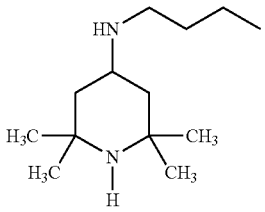

-continued

N,N′-bis(2,2,6,6-tetramethyl-4-piperidyl)hexane-1,6-diamine:

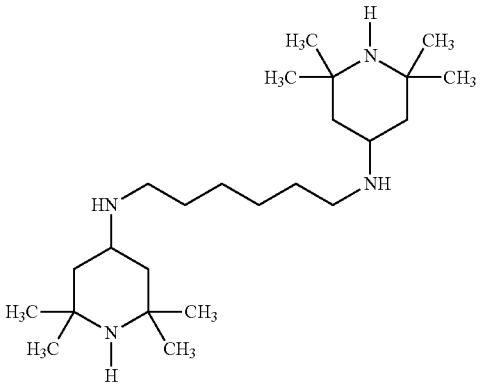

N,N′-dimethyl-N,N′-bis(1,2,2,6,6-pentamethyl-4-piperidyl)hexane-1,6-diamine:

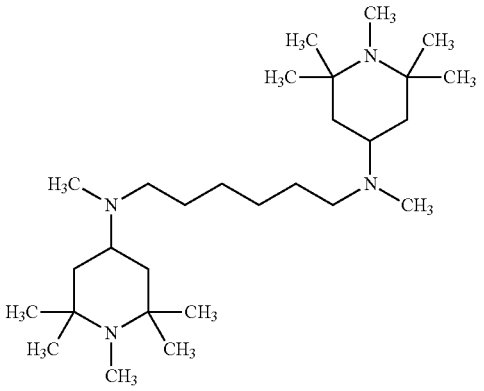

The sterically hindered amine compound may include only two amino groups. However, the sterically hindered amine compound may alternatively include only one amino group. In certain embodiments, the sterically hindered amine compound may include at least one, or only one, piperidine ring. In other embodiments, the sterically hindered amine compound may include four amino groups and two piperidine rings, and may be a bis-functional sterically hindered amine compound. In various embodiments, the sterically hindered amine compound may include greater than four amino groups.

The lubricant composition may include the sulfonate ester and the amine compound in a weight ratio ranging from 1:100 to 10:1, from 1:80 to 2:1, from 1:50 to 10:1, or from 1:10 to 10:1. Alternatively, the lubricant composition may include the sulfonate ester and the amine compound in a weight ratio ranging from 1:3 to 1:6. More specifically, the lubricant composition may include the sulfonate ester and the amine compound in a weight ratio ranging from 1:10 to 10:1, or a weight ratio ranging from 1:3 to 1:6.

If utilized, the lubricant composition includes the amine compound, such as the sterically hindered amine, in an amount of from 0.1 to 25, 0.1 to 20, 0.1 to 15, or 0.1 to 10, wt. %, based on the total weight of the lubricant composition. Alternatively, the lubricant composition may include the amine compound in an amount of from 0.5 to 5, 1 to 3, or 1 to 2, wt. %, based on the total weight of the lubricant composition.

If the amine compound is included in the additive package, the additive package includes the amine compound in an amount of from 0.1 to 50 wt. %, based on the total weight of the additive package. Alternatively, the additive package may include the amine compound in an amount of from 1 to 25, 0.1 to 15, 1 to 10, 0.1 to 8, or 1 to 5, wt. %, based on the total weight of the additive package. Combinations of various amine compounds are also contemplated.

The lubricant composition or the additive packages may further include an amine dispersant in addition to the sulfonate ester and/or the amine compound. The dispersant may be an amine dispersant. As such, depending on the composition of the dispersant, the dispersant may be encompassed by at least one of the descriptions of the amine compound provided above. In certain embodiments, the dispersant is the amine compound. In other embodiments, the dispersant is included in addition to the amine compound. The additive package may consist, or consist essentially of, the sulfonate ester and the amine dispersant.

The total base number of the amine dispersant may be least 15, at least 25, or at least 30, mg KOH/g of the amine dispersant when measured according to ASTM D4739. Alternatively, the TBN value of the amine dispersant may range from 15 to 100, from 15 to 80, or from 15 to 75, mg KOH/g of the amine dispersant, when measured according to ASTM D 4739.

The amine dispersant may be a polyalkene amine. The polyalkene amine includes a polyalkene moiety. The polyalkene moiety is the polymerization product of identical or different, straight-chain or branched $C_{2-6}$ olefin monomers. Examples of suitable olefin monomers are ethylene, propylene, 1-butene, isobutene, 1-pentene, 2-methyl butene, 1-hexene, 2-methylpentene, 3-methylpentene, and 4-methylpentene. The polyalkene moiety has a weight average molecular weight of from 200 to 10000, 500 to 10000, or 800 to 5000.

In one embodiment, the polyalkene amine is derived from polyisobutenes. Particularly suitable polysiobutenes are known as "highly reactive" polyisobutenes which feature a high content of terminal double bonds. Terminal double bonds are alpha-olefinic double bonds of the type shown in general formula (XI):

(XI)

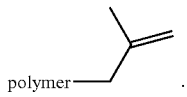

The bonds shown in general formulas (XI) are known as vinylidene double bones. Suitable highly reactive polypolyisobutenes are, for example, polyisobutenes which have a fraction of vinylidene double bonds of greater than 70, 80, or 85, mole %. In certain embodiments, the polyisobutene has a uniform polymer framework. Uniform polymer frameworks have in particular those polyisobutenes which are composed of at least 85, 90, or 95, wt. %, of isobutene units. Such highly reactive polyisobutenes may have a number-average molecular weight in the abovementioned range. In addition, the highly reactive polyisobutenes may have a polydispersity of from 1.05 to 7, or 1.1 to 2.5. The highly reactive polyisobutenes may have a polydispersity less than 1.9, or less than 1.5. Polydispersity refers to the quotients of weight-average molecular weight Mw divided by the number-average molecular weight Mn.

The amine dispersant may include moieties derived from succinic anhydride and having hydroxyl and/or amino and/or amido and/or imido groups. For example, the amine dispersant may be derived from polyisobutenylsuccinic anhydride which is obtainable by reacting conventional or highly reactive polyisobutene having a weight average molecular weight of from 500 to 5000 with maleic anhydride by a thermal route or via the chlorinated polyisobutene. For examples, derivatives with aliphatic polyamines such as ethylenediamine, diethylenetriamine, triethylenetetramine or tetraethylenepentamine may be used.

To prepare the polyalkene amine, the polyalkene component may be aminated in a known manner. An exemplary process proceeds via the preparation of an oxo intermediate by hydroformylation and subsequent reductive amination in the presence of a suitable nitrogen compound.

The dispersant may be a poly(oxyalkyl) radical or a polyalkylene polyamine radical of the general formula (XII):

$$R^{10}—NH—(C_1\text{-}C_6\text{-alkylene-NH})_m—C_1\text{-}C_6\text{-alkylene} \quad (XII)$$

where m is an integer of from 1 to 5, $R^{10}$ is a hydrogen atom or a hydrocarbyl group having from 1 to 6 carbon atoms with $C_1$-$C_6$ alkylene representing the corresponding bridged analogs of the alkyl radicals. The dispersant may also be a polyalkylene imine radical composed of from 1 to 10 $C_1$-$C_4$ alkylene imine groups; or, together with the nitrogen atom to which they are bonded, are an optionally substituted 5- to 7-membered heterocyclic ring which is optionally substituted by one to three $C_1$-$C_4$ alkyl radicals and optionally bears one further ring heteroatom such as oxygen or nitrogen.

Examples of suitable alkenyl radicals include mono- or polyunsaturated, such as mono- or di-unsaturated analogs of alkyl radicals has from 2 to 18 carbon atoms, in which the double bonds may be in any position in the hydrocarbon chain.

Examples of $C_4$-$C_{18}$ cycloalkyl radical include cyclobutyl, cyclopentyl and cyclohexyl, and also the analogs thereof substituted by 1 to 3 $C_1$-$C_4$ alkyl radicals. The $C_1$-$C_4$ alkyl radicals are, for example, selected from methyl, ethyl, iso- or n-propyl, n-, iso-, sec- or tert-butyl.

Examples of the arylalkyl radical include a $C_1$-$C_{18}$ alkyl group and an aryl group which are derived from a monocyclic or bicyclic fused or nonfused 4- to 7-membered, in particular 6 membered, aromatic or heteroaromatic group, such as phenyl, pyridyl, naphthyl and biphenyl.

If additional dispersants other than the dispersant described above are employed, these dispersants can be of various types. Suitable examples of dispersants include polybutenylsuccinic amides or -imides, polybutenylphosphonic acid derivatives and basic magnesium, calcium and barium sulfonates and phenolates, succinate esters and alkylphenol amines (Mannich bases), and combinations thereof.

If employed, the dispersant, such as the amine dispersant, can be used in various amounts. The dispersant may be present in the lubricant composition in an amount of from 0.01 to 15, 0.1 to 12, 0.5 to 10, or 1 to 8, wt. %, based on the total weight of the lubricant composition. Alternatively, the dispersant may be present in amounts of less than 15, less than 12, less than 10, less than 5, or less than 1, wt. %, each based on the total weight of the lubricant composition. In the additive package, the total weight of the dispersant and the sulfonate ester is less than 50, less than 45, less than 40, less than 35, or less than 30, wt. %, of the additive package based on the total weight of the additive package.

The amounts of the dispersant described above, such as the amine dispersant, may be in addition to the amounts of the amine compound utilized in the lubricant composition and/or the additive package.

The lubricant composition may include a base oil. The base oil is classified in accordance with the American Petroleum Institute (API) Base Oil Interchangeability Guidelines. In other words, the base oil may be further described as at least one of five types of base oils: Group I (sulphur content >0.03 wt. %, and/or <90 wt. % saturates, viscosity index 80-119); Group II (sulphur content less than or equal to 0.03 wt. %, and greater than or equal to 90 wt. % saturates, viscosity index 80-119); Group III (sulphur content less than or equal to 0.03 wt. %, and greater than or equal to 90 wt. % saturates, viscosity index greater than or equal to 119); Group IV (all polyalphaolefins (PAO's)); and Group V (all others not included in Groups I, II, III, or IV).

In some embodiments, the base oil is selected from the group of API Group I base oils; API Group II base oils; API Group III base oils; API Group IV base oils; API Group V base oils; and combinations thereof. In other embodiments, the lubricant composition is free from Group I, Group II, Group III, Group IV, or Group V, base oils, and combinations thereof. In one embodiment, the base oil includes API Group II base oils.

The base oil may have a viscosity of from 1 to 50, 1 to 40, 1 to 30, 1 to 25, or 1 to 20, cSt, when tested according to ASTM D445 at 100° C. Alternatively, the viscosity of the base oil may range from 3 to 17, or 5 to 14, cSt, when tested according to ASTM D445 at 100° C.

The base oil may be further defined as a crankcase lubricant oil for spark-ignited and compression-ignited internal combustion engines, including automobile and truck engines, two-cycle engines, four-cycle engines, aviation piston engines, marine engines, and railroad diesel engines. Alternatively, the base oil can be further defined as an oil to be used in gas engines, diesel engines, stationary power engines, and turbines. The base oil may be further defined as heavy or light duty engine oil.

In some embodiments, the lubricant composition is a 'wet' lubricant composition that includes at least one liquid component. The lubricant composition is not a dry lubricant as it requires at least one liquid component to properly lubricate.

In still other embodiments, the base oil may be further defined as synthetic oil that includes at least one alkylene oxide polymers and interpolymers, and derivatives thereof. The terminal hydroxyl groups of the alkylene oxide polymers may be modified by esterification, etherification, or similar reactions. These synthetic oils may be prepared through polymerization of ethylene oxide or propylene oxide to form polyoxyalkylene polymers which can be further reacted to form the synthetic oil. For example, alkyl and aryl ethers of these polyoxyalkylene polymers may be used. For example, methylpolyisopropylene glycol ether having a weight average molecular weight of 1000; diphenyl ether of polyethylene glycol having a molecular weight of 500-1000; or diethyl ether of polypropylene glycol having a weight average molecular weight of 1000-1500 and/or mono- and polycarboxylic esters thereof, such as acetic acid esters, mixed $C_3$-$C_8$ fatty acid esters, and the $C_{13}$ oxo acid diester of tetraethylene glycol may also be utilized as the base oil. Alternatively, the base oil may include a substantially inert, normally liquid, organic diluent, such as mineral oil, naptha, benzene, toluene, or xylene.

The base oil may include less than 90, less than 80, less than 70, less than 60, less than 50, less than 40, less than 30, less than 20, less than 10, less than 5, less than 3, less than 1, wt. %, or be free from, an estolide compound (i.e., a compound including at least one estolide group), based on the total weight of the lubricant composition.

The base oil may be present in the lubricant composition in an amount of from 1 to 99.9, 50 to 99.9, 60 to 99.9, 70 to 99.9, 80 to 99.9, 90 to 99.9, 75 to 95, 80 to 90, or 85 to 95, wt. %, based on the total weight of the lubricant composition. Alternatively, the base oil may be present in the lubricant composition in amounts of greater than 1, 10, 20, 30, 40, 50, 60, 70, 75, 80, 85, 90, 95, 98, or 99, wt. %, based on the total weight of the lubricant composition. In various embodiments, the amount of base oil in a fully formulated lubricant composition (including diluents or carrier oils present) ranges from 50 to 99, 60 to 90, 80 to 99.5, 85 to 96, or 90 to 95, wt. %, based on the total weight of the lubricant composition. Alternatively, the base oil may be present in the lubricant composition in an amount of from 0.1 to 50, 1 to 25, or 1 to 15, wt. %, based on the total weight of the lubricant composition. In various embodiments, the amount of base oil in an additive package, if included, (including diluents or carrier oils present) ranges from 0.1 to 50, 1 to 25, or 1 to 15, wt. %, based on the total weight of the additive package.

The lubricant composition may consist, or consist essentially of, the base oil, the sulfonate ester, and the amine compound, such as a sterically hindered amine compound or the amine dispersant. It is also contemplated that the lubricant composition may consist of, or consist essentially of, the base oil, the sulfonate ester, and the amine compound, in addition to at least one of the additives that do not materially affect the functionality or performance of the sulfonate ester. For example, compounds that materially affect the overall performance of the lubricant composition may include compounds which impact the TBN boost, the lubricity, the fluoropolymer seal compatibility, the corrosion inhibition, or the acidity of the lubricant composition.

In other embodiments, the additive package may consist, or consist essentially of, the sulfonate ester, or consist, or consist essentially of the sulfonate ester and the amine compound, such as the amine compound having a total base number of at least 80 mg KOH/g when tested according to ASTM D4739 or the amine dispersant. It is also contemplated that the additive package may consist of, or consist essentially of, the sulfonate ester, and the amine compound in addition to at least one of the additives that do not compromise the functionality or performance of the sulfonate ester. When used in reference to the additive package, the term "consisting essentially of" refers to the additive package being free of compounds that materially affect the overall performance of the additive package. For example, compounds that materially affect the overall performance of the additive package may include compounds which impact the TBN boost, the lubricity, the fluoropolymer seal compatibility, the corrosion inhibition, or the acidity of the additive package.

The lubricant composition or the additive package may further include an anti-wear compound. The anti-wear compound includes phosphorous in certain embodiments. The anti-wear compound may include sulfur- and/or phosphorus- and/or halogen-containing compounds, e.g., sulfurized olefins and vegetable oils, sulfurized polyisobutenes, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl)phosphorothioate and mixtures thereof, diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis(2-ethylhexyl)aminomethyl]-2-mercapto-1H-1,3-benzothiazole, ethoxycarbonyl-5-octyldithio carbamate, and/or combinations thereof.

In some embodiments, the anti-wear compound may be exemplified by a dihydrocarbyl dithiophosphate salt. The dihydrocarbyl dithiophosphate salt may be represented by the following general formula (XIII):

$$[R^{16}O(R^{17}O)PS(S)]_2M \qquad \text{(XIII).}$$

where $R^{16}$ and $R^{17}$ are each hydrocarbyl groups independently having from 1 to 30, 1 to 20, 1 to 15, 1 to 10, or 1 to 5, carbon atoms, where M is a metal atom or an ammonium group. For example, $R^{16}$ and $R^{17}$ may each independently be $C_{1-20}$ alkyl groups, $C_{2-20}$ alkenyl groups, $C_{3-20}$ cycloalkyl groups, $C_{1-20}$ arylalkyl groups or $C_{3-20}$ aryl groups. The groups designated by $R^{16}$ and $R^{17}$ may be substituted or unsubstituted. The hydrocarbyl groups designated by $R^{16}$ and $R^{17}$ groups may be as described above with respect to $R^1$ in general formula (I). The metal atom may be selected from the group including aluminum, lead, tin, manganese, cobalt, nickel, or zinc. The ammonium group may be derived from ammonia or a primary, secondary, or tertiary amine. The ammonium group may be of the formula $R^{18}R^{19}R^{20}R^{21}N^+$, where $R^{18}$, $R^{19}$, $R^{20}$, and $R^{21}$ each independently represents a hydrogen atom or a hydrocarbyl group having from 1 to 150 carbon atoms. In certain embodiments, $R^{18}$, $R^{19}$, $R^{20}$, and $R^{21}$ may each independently be hydrocarbyl groups having from 4 to 30 carbon atoms. The hydrocarbyl groups designated by $R^{18}$, $R^{19}$, $R^{20}$, and $R^{21}$ may be as described above with respect to $R^1$ in general formula (I). In one embodiment, the dihydrocarbyl dithiophosphate salt is zinc dialkyl dithiophosphate. The lubricant composition may include mixtures of different dihydrocarbyl dithiophosphate salts.

In certain embodiments, the dihydrocarbyl dithiophosphate salt includes a mixture of primary and secondary alkyl groups for, $R^{16}$ and $R^{17}$, where the secondary alkyl groups are in a major molar proportion, such as at least 60, at least 75, or at least 85, mole %, based on the number of moles of alkyl groups in the dihydrocarbyl dithiophosphate salt.

In some embodiments, the anti-wear compound may be ashless. The anti-wear compound may be further defined as a phosphate. In another embodiment, the anti-wear compound is further defined as a phosphite. In still another embodiment, the anti-wear compound is further defined as a phosphorothionate. The anti-wear compound may alternatively be further defined as a phosphorodithioate. In one embodiment, the anti-wear compound is further defined as a dithiophosphate. The anti-wear compound may also include an amine such as a secondary or tertiary amine. In one embodiment, the anti-wear compound includes an alkyl and/or dialkyl amine. Structures of non-limiting examples of anti-wear compounds are set forth immediately below:

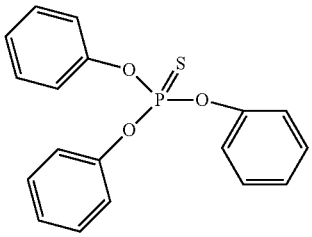

Triphenyl Phosphorothionate

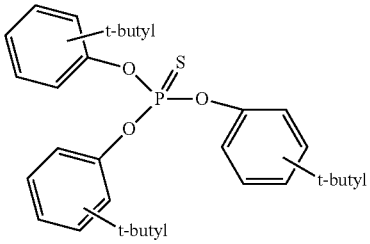

Butylated Triphenyl Phosphorothionate

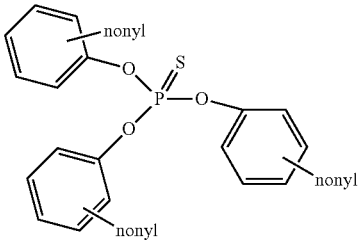

Nonyl Triphenyl Phosphorothionate

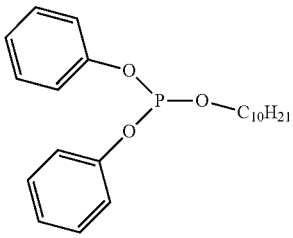

Decyl Diphenylphosphite

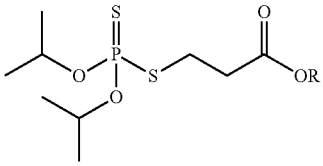

Neutral Dialkyl Dithiophosphate

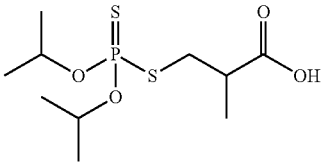

Acidic Dialkyl Dithiophosphate

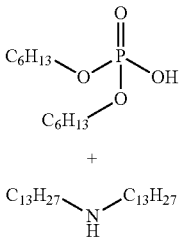

Amine Phosphate + Ditridecyl Amine

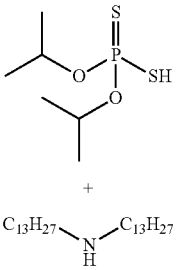

Isopropyl Phosphorodithioate + Ditridecyl Amine

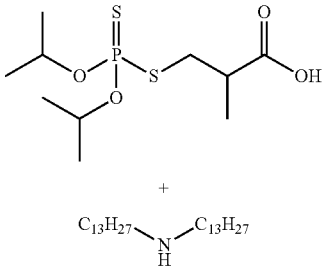

Acidic Dialkyl Dithiophosphate + Ditridecyl Amine

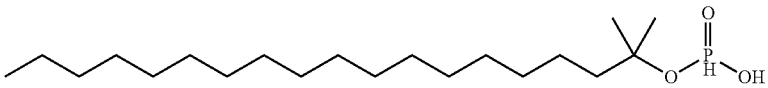

2-methylnonadecan-2-yl hydrogen phosphonate

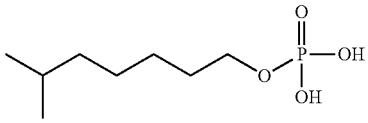

Iso-Octyl Phosphate + C12-C14 Amine

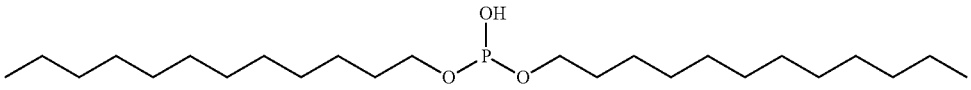

didodecyl hydrogen phosphite

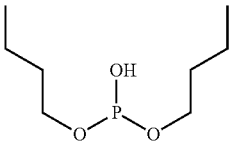

dibutyl hydrogen phosphite

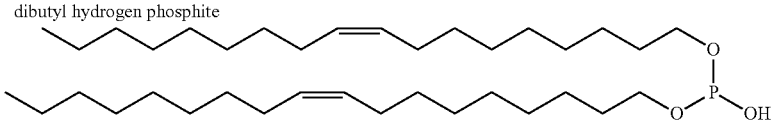

di((Z)-octadec-9-en-1-yl) hydrogen phosphite

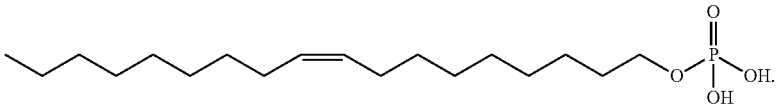

(Z)-octadec-9-en-1-yl dihydrogen phosphate

In other embodiments, the anti-wear compound includes molybdenum. For example, the anti-wear compound including molybdenum may be exemplified by any suitable oil-soluble organo-molybdenum compound. In certain embodiments, the anti-wear compound including molybdenum is dinuclear or trinuclear. Typically, the anti-wear compound including molybdenum includes a molybdenum-sulfur core formed from one or more molybdenum atoms and one or more sulfur atoms. Non-limiting examples of suitable anti-wear compound including molybdenum include molybdenum dithiocarbamates, molybdenum dithiophosphates, molybdenum dialkyldithiophosphates, molybdenum dithiophosphinates, molybdenum xanthates, molybdenum alkyl xanthates, molybdenum alkylthioxanthates, molybdenum thioxanthates, molybdenum sulfides, and combinations thereof.

In various embodiments, the anti-wear compound may include phosphorus and molybdenum in a single compound. It is to be appreciated that one or more of the anti-wear compounds including phosphorus described above may include phosphorus and molybdenum in a single compound. It is also to be appreciated that one or more of the anti-wear compounds including molybdenum described above may include phosphorus and molybdenum in a single compound.

The anti-wear compound can be present in the lubricant composition in an amount of from 0.1 to 99.9, 0.1 to 75, 0.1 to 50, 1 to 30, 0.1 to 20, 0.5 to 15, 1 to 10, 0.1 to 5, 0.1 to 1, 0.1 to 0.5, or 0.1 to 1.5, wt. %, each based on the total weight of the lubricant composition. Alternatively, the anti-wear compound may be present in amounts of less than 20, less than 10, less than 5, less than 1, less than 0.5, or less than 0.1, wt. %, each based on the total weight of the lubricant composition. The additive package may also include the anti-wear compound in an amount of from 0.1 to 20, 0.5 to 15, 1 to 10, 0.1 to 5, 0.1 to 1, 0.1 to 0.5, or 0.1 to 1.5, wt. %, each based on the total weight of the additive package.

The lubricant composition or additive package may include additives in addition to the sulfonate ester, the amine compound, the dispersant, and/or the anti-wear compound. These additional additives include, but are not limited to, detergents, amine antioxidants, phenolic antioxidants, anti-foam additives, metal deactivators, rust inhibitors, pour point depressants, viscosity modifiers, and combinations thereof. Each of the additives may be used alone or in combination. The one or more additives can be used in various amounts, if employed. The lubricant composition may be formulated with the addition of several auxiliary components to achieve certain performance objectives for use in certain applications. For example, the lubricant composition may be a rust and oxidation lubricant formulation, a hydraulic lubricant formulation, turbine lubricant oil, and an internal combustion engine lubricant formulation. Accordingly, it is contemplated that the base oil may be formulated to achieve these objectives as discussed below.

If employed, the antioxidant can be of various types. Suitable antioxidants include alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Further examples of suitable antioxidants includes alkylthiomethylphenols, for example, 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example, 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl) adipate, and combinations thereof, may also be utilized.

Furthermore, hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl)disulfide, and combinations thereof, may also be used.

It is also contemplated that alkylidenebisphenols, for example 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol),1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercapto butane, ethylene glycol bis[3,3-bis(3'-tert-butyl-4'-hydroxyphenyl)butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants in the lubricant composition.

O-, N- and S-benzyl compounds, for example 3,5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl) malonate, and combinations thereof are also suitable for use as antioxidants.

Triazine compounds, for example, 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris (3,5-di-tert-butyl-4-hydroxyphenyl propionyl)-hexahydro- 1,3,5-triazine, 1,3,5-tris-(3,5-dicyclohexyl-4-hydroxybenzyl)-isocyanurate, and combinations thereof, may also be used.

Additional examples of antioxidants include aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl) phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl3,5-di-tert-butyl-4-hydroxybenzylphosphonate, dioctadecyl-5-tert-butyl-4-hydroxy3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example 4-hydroxylauranilide, 4-hydroxystearanilide, octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis (hydroxyethyl)oxamide, 3-thiaundecanol, 3-thiapentadecanol, trimethylhexanediol, trimethylolpropane, 4-hydroxymethyl-1-phospha-2,6,7-trioxabicyclo [2.2.2]octane, and combinations thereof, may also be used. It is further contemplated that esters of β-(5-tert-butyl-4-hydroxy-3-methylphenyl)-propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl) isocyanurate, N,N'-bis(hydroxyethyl) oxamide, 3-thiaundecanol, 3-thiapentadecanol, trimethylhexanediol, trimethylolpropane, 4-hydroxymethyl-1-phospha-2,6,7-trioxabicyclo octane, and combinations thereof, may be used.

Additional examples of suitable antioxidants include those that include nitrogen, such as amides of β-(3,5-di-tert-butyl-4-hydroxyphenyl)propionic acid, e.g., N,N-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine. Other suitable examples of antioxidants include aminic antioxidants such as N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'-diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino)propane, (o-tolyl)biguanide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N-tetraphenyl-1,4-diaminobut-2-ene, N,N-bis(2,2,6,6-tetramethylpiperid-4-yl-hexamethylenediamine, bis(2,2,6,6-tetramethyl piperid-4-yl)sebacate, 2,2,6,6-tetramethylpiperidin-4-one and 2,2,6,6-tetramethyl piperidin-4-ol, and combinations thereof. In certain embodiments, certain antioxidants that include nitrogen may be considered the amine compound described above.

Even further examples of suitable antioxidants include aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1trithiatridecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used.

If employed, the antioxidant can be used in various amounts. The antioxidant may be present in the additive package in an amount ranging from 0.1 to 99, from 1 to 70, from 5 to 50, or from 25 to 50, wt. %, based on the total weight of the additive package. The antioxidant may be present in the lubricant composition in an amount ranging from 0.01 to 5, from 0.1 to 3, or from 0.5 to 2, wt. %, based on the total weight of the lubricant composition.

If employed, the metal deactivator can be of various types. Suitable metal deactivators include benzotriazoles and derivatives thereof, for example 4- or 5 alkylbenzotriazoles (e.g. tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl)tolutriazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl) tolutriazole, and combinations thereof.

Additional examples of suitable metal deactivators include 1,2,4-triazoles and derivatives thereof, for example 3 alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4,4'-methylenebis(2-undecyl-5-methylimidazole) and bis[(N-methyl)imidazol-2-yl] carbinol octyl ether, and combinations thereof. Further examples of suitable metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further examples of metal deactivators include amino compounds, for example salicylidenepropylenediamine, salicylaminoguanidine and salts thereof, and combinations thereof.

If employed, the metal deactivator can be used in various amounts. The metal deactivator may be present in the additive package in an amount ranging from 0.1 to 99, from 1 to 70, from 5 to 50, or from 25 to 50, wt. %, based on the total weight of the additive package. The metal deactivator may be present in the lubricant composition in an amount ranging from 0.01 to 0.1, from 0.05 to 0.01, or from 0.07 to 0.1, wt. %, based on the total weight of the lubricant composition.

If employed, the rust inhibitor and/or friction modifier can be of various types. Suitable examples of rust inhibitors and/or friction modifiers include organic acids, their esters, metal salts, amine salts and anhydrides, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy)acetic acid and the amine salts thereof, and also N-oleoylsarcosine, sorbitan monooleate, lead naphthenate, alkenylsuccinic anhydrides, for example, dodecenylsuccinic anhydride, 2-carboxymethyl-1-dodecyl-3-methylglycerol and the amine salts thereof, and combinations thereof. Additional examples include nitrogen-containing compounds, for example, primary, secondary or tertiary aliphatic or cycloaliphatic amines and amine salts of organic and inorganic acids, for example oil-soluble alkylammonium carboxylates, and also 1-[N,N-bis(2-hydroxyethyl)amino]-3-(4-nonylphenoxy) propan-2-ol, and combinations thereof. Further examples include heterocyclic compounds, such as substituted imidazolines and oxazolines, and 2-heptadecenyl-1-(2-hydroxyethyl)imidazoline, phosphorus-containing compounds, for example: amine salts of phosphoric acid partial esters or phosphonic acid partial esters, molybdenum containing compounds, such as molydbenum dithiocarbamate and other sulphur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl) glycerols and 2-carboxyalkyl-1,3-dialkylglycerols, and combinations thereof.

If employed, the rust inhibitor and/or friction modifier can be used in various amounts. The rust inhibitor and/or friction modifier may be present in the additive package in an amount ranging from 0.01 to 0.1, from 0.05 to 0.01, or from 0.07 to 0.1, wt. %, based on the total weight of the additive package. The rust inhibitor and/or friction modifier may be present in the lubricant composition in an amount ranging from 0.01 to 5, from 0.1 to 3, from 0.1 to 1, from 0.05 to 0.01, or from 0.07 to 0.1, wt. %, based on the total weight of the lubricant composition.

If employed, the viscosity index improver (VII) can be of various types. Suitable examples of VIIs include polyacrylates, polymethacrylates, vinylpyrrolidone/methacrylate copolymers, polyvinylpyrrolidones, polybutenes, olefin copolymers, styrene/acrylate copolymers and polyethers, and combinations thereof.

If employed, the VII can be used in various amounts. The VII may be present in the additive package in an amount ranging from 0.01 to 20, from 1 to 15, or from 1 to 10, wt. %, based on the total weight of the additive package. The VII may be present in the lubricant composition in an amount ranging from 0.01 to 20, from 1 to 15, or from 1 to 10, wt. %, based on the total weight of the lubricant composition.

If employed, the pour point depressant can be of various types. Suitable examples of pour point depressants include polymethacrylate and alkylated naphthalene derivatives, and combinations thereof.

If employed, the pour point depressant can be used in various amounts. The pour point depressant may be present in the additive package in an amount ranging from 0.1 to 99, from 1 to 70, from 5 to 50, or from 25 to 50, wt. %, based on the total weight of the additive package. The pour point depressant may be present in the lubricant composition in an amount ranging from 0.01 to 0.1, from 0.05 to 0.01, or from 0.07 to 0.1, wt. %, each based on the total weight of the lubricant composition.

If employed, the detergent can be of various types. Detergents are the metal salts of organic acids. The reaction of these acids with inorganic bases, such as metal oxides, metal hydroxides, and metal carbonates, result in the formation of salts. Neutral detergents include a stoichiometric amount of the metal oxide to neutralize the acid functionality of the organic acid while overbased detergents include an excess of the metal oxide. Suitable examples of detergents include overbased or neutral metal sulfonates, phenates and salicylates, and combinations thereof. The detergent may be included in addition to the sulfonate ester described above in the lubricant composition.

If employed, the detergent can be used in various amounts. The detergent may be present in the additive package in an amount ranging from 0.1 to 99, from 1 to 70, from 5 to 50, or from 25 to 50, wt. %, based on the total weight of the additive package. The detergent may be present in the lubricant composition in an amount ranging from 0.01 to 5, from 0.1 to 4, from 0.5 to 3, or from 1 to 3, wt. %, based on the total weight of the lubricant composition. Alternatively, the detergent may be present in amounts of less than 5, less than 4, less than 3, less than 2, or less than 1, wt. %, based on the total weight of the lubricant composition.

The lubricant composition may include the additive package in amount of at least 3, at least 4, at least 5, at least 6, at least 7, or at least 8, wt. %, based on a total weight of the lubricant composition. Alternatively, the lubricant composition may include the additive package in an amount of from 3 to 20, 4 to 18, 5 to 16, or 6 to 14, wt. %, based on a total weight of the lubricant composition. In some embodiments, the additive package does not account for the weight of the base oil as an additive. Although not required, the additive package includes all compounds in the lubricant composition other than the base oil. However, it is to be appreciated that certain individual components can be independently and individually added to the lubricant composition separate from the addition of the additive package to the lubricant composition, yet still be considered part of the additive package once the additive which was individually added into the lubricant composition is present in the lubricant composition along with the other additives.

The additive package refers to the collective amount of the sulfonate esters, amine compounds, dispersants, detergents, aminic antioxidants, phenolic antioxidants, friction modifiers anti-foam additives, anti-wear compounds, pour point depressants, viscosity modifiers, or combinations thereof in a solution, mixture, concentrate, or blend, such as the lubricant composition. In some embodiments, the term "additive package" does not require that these additives are physically packaged together or blended together before addition to the base oil. Thus, a base oil which includes the sulfonate ester and the dispersant, each added to the base oil separately, could be interpreted to be a lubricant composition that includes an additive package including the sulfonate ester and the dispersant. In other embodiments, the additive package refers to a blend of the sulfonate esters, amine compounds, dispersants, detergents, aminic antioxidants, phenolic antioxidants, friction modifiers, anti-foam additives, anti-wear compounds, pour point depressants, viscosity modifiers, or combinations thereof. The additive package may be blended into the base oil to make the lubricant composition.

The additive package may be formulated to provide the desired concentration in the lubricant composition when the additive package is combined with a predetermined amount of base oil. It is to be appreciated that most references to the lubricant composition throughout this disclosure also apply to the description of the additive package. For example, it is to be appreciated that the additive package may include, or exclude, the same components as the lubricant composition, albeit in different amounts.

The additive package may consist, or consist essentially of, the sulfonate ester, the anti-wear compound, and/or the amine compound. It is also contemplated that the additive package may consist of, or consists essentially of, the sulfonate ester, the anti-wear compound, and the amine compound, in addition to one or more of additives that do not compromise the functionality or performance of the sulfonate ester, the anti-wear compound, or the amine compound. In other embodiments, the terminology "consisting essentially of" describes the additive package as being free of compounds that materially affect the overall performance of the additive package as recognized by one of ordinary skill in the art. For example, compounds that materially affect the overall performance of the additive package may be described by compounds which negatively impact the TBN boost, the lubricity, the fluoropolymer seal compatibility, the corrosion inhibition, or the acidity of the lubricant composition formed from the additive package.

The lubricant composition may have a sulfur content of less than about 0.4 wt. %, less than about 0.35 wt. % or less than about 0.03 wt. %, such as less than about 0.20 wt. %. The Noack volatility (ASTM D5880) of the lubricant composition (oil of lubricating viscosity plus all additives and additive diluent) may be no greater than 13, such as no greater than 12, or alternatively, no greater than 10.

It may be desirable, although not essential to prepare one or more additive packages comprising additives (the additive packages may also be referred to as additive concentrates) whereby several additives can be added simultaneously to the oil to form the lubricant composition.

In one or more embodiments, the lubricant composition may be classified as a low SAPS lubricant having a sulfated ash content of no more than 3, 2, 1, or 0.5, wt. %, based on the total weight of the lubricant composition. "SAPS" refers to sulfated ash, phosphorous and sulfur.

The lubricant composition may have a TBN value of at least 1, at least 3, at least 5, at least 7, at least 9, mg KOH/g of lubricant composition, when tested according to ASTM D2896. Alternatively, the lubricant composition has a TBN value of from 3 to 100, 3 to 75, 50 to 90, 3 to 45, 3 to 35, 3 to 25, 3 to 15, or 9 to 12, mg KOH/g of lubricant composition, when tested according to ASTM D2896.

In certain embodiments, the lubricant composition derives at least 5%, at least 10%, or at least 20% of the compositional TBN (as measured in accordance with ASTM D4739) from ashless TBN sources including the amine compound. Alternatively, lubricant composition derives at least 5%, at least 10%, or at least 20% of the compositional TBN from the amine compound. In certain embodiments, the lubricant composition contains an amount of the amine compound that contributes from about 0.5 to about 15 mg KOH/g, from about 0.5 to about 10 mg KOH/g, from about 0.5 to about 4 mg KOH/g, or from about 1 to about 3 mg KOH/g of TBN (ASTM D4739) to the lubricant composition.

In certain embodiments, the lubricant composition is a multigrade lubricant composition identified by the viscometric descriptor SAE15WX, SAE 10WX, SAE 5WX or SAE 0WX, where X is 8, 12, 16, 20, 30, 40, or 50. The characteristics of at least one of the different viscometric grades can be found in the SAE J300 classification.

The lubricant composition may have a phosphorus content of less than 1500, less than 1200, less than 1000, less than 800, less than 600, less than 400, less than 300, less than 200, or less than 100, or 0, ppm, as measured according to the ASTM D5185 standard, or as measured according to the ASTM D4951 standard. The lubricant composition may have a sulfur content of less than 3000, less than 2500, less than 2000, less than 1500, less than 1200, less than 1000, less than 700, less than 500, less than 300, or less than 100, ppm, as measured according to the ASTM D5185 standard, or as measured according to the ASTM D4951 standard.

Alternatively, the lubricant composition may have a phosphorous content of from 1 to 1000, 1 to 800, 100 to 700, or 100 to 600, ppm, as measured according to the ASTM D5185 standard.

The final lubricant composition may employ from 5 to 25 wt. %, alternatively 5 to 18 wt. %, or 10 to 15 wt. % of the additive package, the remainder being oil of lubricating viscosity and viscosity modifier. In certain embodiments, the additive package includes the base oil. If included, the additive package includes the base oil in an amount ranging from 0.1 to 50, from 1 to 25, or from 1 to 15, wt. %, based on the total weight of the additive package.

The lubricant composition may be free from, or substantially free from, a carboxylic acid ester and/or phosphate ester. For example, the lubricant composition may include less than 20, less than 15, less than 10, less than 5, less than 3, less than 1, less than 0.5, or less than 0.1, wt. %, carboxylic acid ester and/or phosphate ester. The carboxylic acid ester and/or phosphate ester may be included as conventional base oil in water-reactive functional fluids. Alternatively, the lubricant composition may be free from a carboxylic acid ester base oil and/or phosphate ester base oil, which are liquid at a steady state temperature of 25° C. and a steady state pressure of 1 atmosphere.

In certain embodiments, the present disclosure provides lubricant compositions, having crankcase lubricant compositions for heavy duty diesel (HDD) engines, containing the containing the sulfonate ester and one or more amines compounds useful as additives for increasing the TBN of lubricant compositions without introducing sulfated ash.

In certain embodiments, the present disclosure provides lubricant compositions meeting the performance criteria of one or more of the ACEA E6, MB p228.51, API C-4+ and API CJ-4 specifications for heavy duty engine lubricants.

In certain embodiments, the present disclosure provides a heavy duty diesel engine equipped with an exhaust gas recirculation (EGR) system (for example, a condensed EGR system and a particulate trap) the crankcase of which engine is lubricated with a lubricant composition.

In certain embodiments, the present disclosure provides a method for forming a high TBN lubricant composition having a reduced SASH content comprising incorporating into a lubricant composition one or more amine compounds useful as additives for increasing the TBN of lubricant compositions without introducing sulfated ash and incorporating the sulfonate ester.

The lubricant composition may be unreactive with water. By unreactive with water, it is meant that less than 5, 4, 3, 2, 1, 0.5, or 0.1, wt., %, of the lubricant composition reacts with water at 1 atmosphere of pressure and 25° C.

The lubricant composition may be substantially free of water, e.g., the lubricant composition includes less than 5, less than 4, less than 3, less than 2, less than 1, less than 0.5, or less than 0.1, wt. %, of water based on the total weight of the lubricant composition. Alternatively, the lubricant composition may be completely free of water. Similarly, the additive package may be substantially free of water, e.g., the additive package includes less than 5, 4, 3, 2, 1, 0.5, or 0.1, wt. %, of water based on the total weight of the additive package. Alternatively, the additive package may be completely free of water.

In various embodiments, the lubricant composition is substantially free of water, e.g., the lubricant composition includes less than 5, less than 4, less than 3, less than 2, less than 1, less than 0.5, or less than 0.1, wt. %, of water, based on the total weight of the lubricant composition. Alternatively, the lubricant composition may be completely free of water.

The lubricant composition may include less than 50, less than 25, less than 10, less than 5, less than 1, less than 0.1, or less than 0.01, wt. %, of a halogen-containing compound, such as a compound that includes fluorine, chlorine, iodine, or bromine, such as alkyl halides or halogen ether compounds, based on the total weight of the lubricant composition.

The lubricant composition may include less than 50, less than 25, less than 10, less than 5, less than 1, less than 0.1, or less than 0.01, wt. %, of a fluorinated base oil, or the lubricant composition may be free from a fluorinated base oil. The phrase "fluorinated base oil" may be understood to include any fluorinated oil components, such as perfluoropolyethers or fluorocarbons. Exemplary perfluoropolyethers are described below:

$CF_3CF_2CF_2$—O—$[CF(CF_3)CF_2$—O$]_n CF_2CF_3$,
$CF_3O[CF(CF_3)CF_2O]_y$—$[CF_2O]_m CF_3$,
$CF_3O[CF_2CF_2$—O-$]_z$—$[CF_2$—O—$]_p CF_3$,
$CF_3CF_2CF_2O[CF_2CF_2CF_2O]_q CF_2CF_3$, and
halocarbons containing the repeating group —$(CF_2CFCl)_r$, where n is an integer from 0 to 60; y is an integer from 0 to 60; m is an integer from 0 to 60; z is an integer from 0 to 60; p is an integer from 0 to 60; q is an integer from 0 to 60; and r is an integer from 2 to 10.

In some aspects, the fluorinated base oil may also be generally defined as any component that includes more than 1, 5, 10, 15, or 20 fluorine atoms per molecule.

In one embodiment, the lubricant composition passes ASTM D4951 for phosphorus content. ASTM D4951 is a standard test method for determination of additive elements in lubricant compositions by inductively coupled plasma atomic emission spectrometry (ICP-OES).

In another embodiment, the lubricant composition passes ASTM D6795, which is a standard test method for measuring the effect on filterability of lubricant compositions after treatment with water and dry ice and a short (30 min) heating time. ASTM D6795 simulates a problem that may be encountered in a new engine run for a short period of time, followed by a long period of storage with some water in the oil. ASTM D6795 is designed to determine the tendency of a lubricant composition to form a precipitate that can plug an oil filter.

In another embodiment, the lubricant composition passes ASTM D6794, which is a standard test method for measuring the effect on filterability of lubricant composition after treatment with various amounts of water and a long (6 h) heating time. ASTM D6794 simulates a problem that may be encountered in a new engine run for a short period of time, followed by a long period of storage with some water in the oil. ASTM D6794 is also designed to determine the tendency of the lubricant composition to form a precipitate that can plug an oil filter.

In another embodiment, the lubricant composition passes ASTM D6922, which is a standard test method for determining homogeneity and miscibility in lubricant compositions. ASTM D6922 is designed to determine if a lubricant composition is homogeneous and will remain so, and if the lubricant composition is miscible with certain standard reference oils after being submitted to a prescribed cycle of temperature changes.

In another embodiment, the lubricant composition passes ASTM D5133, which is a standard test method for low temperature, low shear rate, viscosity/temperature dependence of lubricating oils using a temperature-scanning technique. The low-temperature, low-shear viscometric behavior of a lubricant composition determines whether the lubricant composition will flow to a sump inlet screen, then to an oil pump, then to sites in an engine requiring lubrication in sufficient quantity to prevent engine damage immediately or ultimately after cold temperature starting.

In another embodiment, the lubricant composition passes ASTM D5800 and/or ASTM D6417, both of which are test methods for determining an evaporation loss of a lubricant composition. The evaporation loss is of particular importance in engine lubrication, because where high temperatures occur, portions of a lubricant composition can evaporate and thus alter the properties of the lubricant composition.

In another embodiment, the lubricant composition passes ASTM D6557, which is a standard test method for evaluation of rust preventive characteristics of lubricant compositions. ASTM D6557 includes a Ball Rust Test (BRT) procedure for evaluating the anti-rust ability of lubricant compositions. This BRT procedure is particularly suitable for the evaluation of lubricant compositions under low-temperature and acidic service conditions.

In another embodiment, the lubricant composition passes ASTM D4951 for sulfur content. ASTM D4951 is a standard test method for determination of additive elements in lubricant compositions by ICP-OES. In addition, the lubricant composition also passes ASTM D2622, which is a standard test method for sulfur in petroleum products by wavelength dispersive x-ray fluorescence spectrometry.

In another embodiment, the lubricant composition passes ASTM D6891, which is a standard test method for evaluating a lubricant composition in a sequence IVA spark-ignition engine. ASTM D6891 is designed to simulate extended engine idling vehicle operation. Specifically, ASTM D6891 measures the ability of a lubricant composition to control camshaft lobe wear for spark-ignition engines equipped with an overhead valve-train and sliding cam followers.

In another embodiment, the lubricant composition passes ASTM D6593, which is a standard test method for evaluating lubricant compositions for inhibition of deposit formation in a spark-ignition internal combustion engine fueled with gasoline and operated under low-temperature, light-duty conditions. ASTM D6593 is designed to evaluate a lubricant composition's control of engine deposits under operating conditions deliberately selected to accelerate deposit formation.

In another embodiment, the lubricant composition passes ASTM D6709, which is a standard test method for evaluating lubricant compositions in a sequence VIII spark-ignition engine. ASTM D6709 is designed to evaluate lubricant compositions for protection of engines against bearing weight loss.

In yet another embodiment, the lubricant composition passes ASTM D6984—the standard test method for evaluation of automotive engine oils in the Sequence IIIF, Spark-Ignition. In other words, the viscosity increase of the lubricant composition at the end of the test is less than 275% relative to the viscosity of the lubricant composition at the beginning of the test.

In another embodiment, the lubricant composition passes two, three, four, or more of the following standard test methods: ASTM D4951, ASTM D6795, ASTM D6794, ASTM D6922, ASTM D5133, ASTM D6557, ASTM D6891, ASTM D2622, ASTM D6593, and ASTM D6709.

The lubricant composition may be a lubricant composition, such as a crankcase lubricant composition, having a total additive treat rate of at least 3, at least 4, at least 5, at least 6, at least 7, or at least 8, wt. %, based on a total weight of the lubricant composition. Alternatively, the lubricant composition may have a total additive treat rate ranging from 3 to 25, 4 to 18, 5 to 16, or 6 to 14, wt. %, based on a total weight of the lubricant composition. The term "total additive treat rate" refers to the total weight percentage of additives included in the lubricant composition. The additives accounted for in the total additive treat rate include, but are not limited to, sulfonate esters, amine compounds, dispersants, detergents, aminic antioxidants, phenolic antioxidants, anti-foam additives, anti-wear compounds, pour point depressants, viscosity modifiers, and combinations thereof. In certain embodiments, an additive is any compound in the lubricant composition other than the base oil. In other words, the total additive treat rate calculation does not account for the base oil as an additive.

Some of the compounds described above may interact in the lubricant composition, so that the components of the lubricant composition in final form may be different from those components that are initially added or combined together. Some products formed thereby, including products formed upon employing the lubricant composition of this invention in its intended use, are not easily described or describable. Nevertheless, all such modifications, reaction products, and products formed upon employing the lubricant composition of this invention in its intended use, are expressly contemplated and hereby included herein. Various embodiments of this invention include one or more of the modification, reaction products, and products formed from employing the lubricant composition, as described above.

A method of improving compatibility of the lubricant composition with the fluoropolymer seal disposed in the internal combustion engine is provided. The method includes providing the lubricant composition including the sulfonate ester as described above. In certain embodiments, the lubricant composition further includes the amine compound, the dispersant, and/or the anti-wear compound. The method also includes heating the lubricant composition. In other words, a use of the sulfonate ester to improve the fluoropolymer seal compatibility of a lubricant composition, optionally comprising an anti-wear compound and/or an amine compound, is also contemplated.

The step of heating the lubricant composition may be generally understood as referring to any process that results in an increase of temperature of the lubricant composition. The step of heating may be inherent to continued use and operation of the lubricant composition in the internal combustion engine. For example, the step of heating may occur while the lubricant composition is circulated through the internal combustion engine for the primary purpose of lubricating one or more components of the internal combustion engine. Alternatively, the step of heating may be purposeful relative to a step of operating the internal combustion engine and/or a step of circulating the lubricant composition through the internal combustion engine, such as a step including direct heating of the lubricant composition or a step including indirect heating of the internal combustion engine.

In one embodiment, the step of heating the lubricant composition may be understood as operating the internal combustion engine in a manner that generates heat during combustion of fuel, and transferring at least a portion of the heat generated from the combustion to the lubricant composition that is disposed within at least a portion of the internal combustion engine. For example, the step of heating the lubricant composition may refer to a step of transferring heat to the lubricant composition through conductive heating of the lubricant composition as the lubricant composition circulates through the internal combustion and contacts one or more components of the internal combustion engine, including, but not limited to, a block, a piston, and/or a crankshaft, such that the temperature of the lubricant composition is raised.

In another embodiment, the step of heating the lubricant composition may be generally understood as transferring heat to the lubricant composition by at least one of the following processes: placing the lubricant composition in an environment having an ambient temperature higher than the temperature of the lubricant composition; indirect heating of the lubricant composition with a heat exchanger, and direct heating of the lubricant composition through exposure to a heating element having a temperature greater than the temperature of the lubricant composition before heating.

The lubricant composition may be heated to a temperature of at least 50° C., at least 60° C., at least 70° C., at least 80° C., at least 90° C., or at least 100° C. Alternatively, the lubricant composition may be heated to a temperature from 50 to 200° C., from 50 to 175° C., from 50 to 150° C., from 50 to 125° C., from 50 to 100° C., from 75 to 200° C., from 75 to 175° C., from 75 to 150° C., from 75 to 125° C., from 100 to 200° C., from 100 to 175° C., or from 100 to 150° C.

In certain embodiments, the internal combustion engine includes a fluid transfer mechanism, such as an oil pump. The fluid transfer mechanism circulates the lubricant composition to at least one part of the internal combustion engine. The fluid transfer mechanism may circulate the lubricant composition through the internal combustion engine such that the lubricant composition contacts the fluoropolymer seal. The step of circulating the lubricant composition through the internal combustion engine may include the step of circulating the lubricant composition to one or more pistons of the internal combustion engine. In certain embodiments, the oil pump may circulate the lubricant composition to an engine part in proximity to the fluoropolymer seal such that the lubricant composition is moved from the engine part to the fluoropolymer seal, and thereby contacts the fluoropolymer seal, during operation of the internal combustion engine. Examples of the engine part may include, but are not limited to, a head gasket, a bearing, a piston, a crankshaft, a camshaft, a ring, a spring, a valve stem, and combinations thereof.

In certain embodiments, a disk plate is fixed to an end of the crankshaft of the internal combustion engine, and the fluoropolymer seal is provided to contact a side face of the disk plate, and a gear room of the crankshaft end side is sealed against leakage of the lubricant composition to the outside by the fluoropolymer seal. The fluoropolymer seal contacts the side face of the disk plate, which is fixed to the crankshaft and rotates at high speed during operation of the engine. The fluoropolymer seal is cooled by drops of the lubricant composition that are provided to the fluoropolymer seal by the oil pump, which fall down onto the side contacting part of the fluoropolymer seal in the gear room.

The method of improving the fluoropolymer seal compatibility of the lubricant composition may include the step of contacting the fluoropolymer seal with the lubricant composition. As described above with respect to the step of circulating the lubricant composition, the fluoropolymer seal may be disposed in various locations in the internal combustion engine. The step of contacting the fluoropolymer seal may include contacting the fluoropolymer seal disposed in various locations, including, but not limited to, the head gasket, the bearing, the piston, the crankshaft, the camshaft, the ring, the spring, the valve stem, or combinations thereof. The step of contacting the fluoropolymer seal with the lubricant composition may be performed in various intervals, of various durations. The lubricant composition may be contacting the fluoropolymer seal continuously or intermittently. In other words, the lubricant composition does not necessarily contact the fluoropolymer seal of the internal combustion engine at all times during the step of operating the internal combustion engine. However, it is to be understood that in some embodiments, the lubricant composition may contact the fluoropolymer seal at all times during the step of operating the internal combustion engine.

The phrase "fluoropolymer seal" refers to a component of a sealing assembly that includes at least one or more fluoropolymer compound. The at least one or more fluoropolymer compound may be a blend of fluoropolymer compounds, a cross-linked fluoropolymer compound, a polymer matrix formed of the at least one or more fluoropolymer compounds, or combinations thereof. The blend of fluoropolymer compounds may be a blend of at least one or more of the crosslinked fluoropolymer compounds or the non-crosslinked fluoropolymer compounds, with at least one or more of the crosslinked fluoropolymer compounds, the non-crosslinked fluoropolymer compounds, or a polymer other than the at least one or more fluoropolymer compound. The polymer other than the at least one or more fluoropolymer compound that may be used in the blend of fluoropolymer compounds includes, but is not limited to, an acrylonitrile-butadiene rubber, a hydrogenated acrylonitrile-butadiene rubber, an ethylene propylene diene rubber, a silicone rubber, a chloroprene rubber, a neoprene rubber, a polyester urethane, a polyether urethane, a natural rubber, a polyacrylate rubber, an ethylene acrylic, a styrene-butadiene rubber, an ethylene oxide epichlorohydrine rubber, a chlorosulfonated polyethylene, a butadiene rubber, an isoprene rubber, a butyl rubber, and combinations and derivatives thereof.

In certain embodiments, the non-fluoropolymer seal may be used in place of the fluoropolymer seal. The non-fluoropolymer seal may be free of the at least one or more fluoropolymer compound and may include one or more of the polymers other than the at least one or more fluoropolymer compound, such as, but not limited to, acrylonitrile-butadiene rubber, hydrogenated acrylonitrile-butadiene rubber, ethylene propylene diene rubber, silicone rubber, chloroprene rubber, neoprene rubber, polyester urethane, polyether urethane, natural rubber, polyacrylate rubber, ethylene acrylic, styrene-butadiene rubber, ethylene oxide epichlorohydrine rubber, chlorosulfonated polyethylene, butadiene rubber, isoprene rubber, butyl rubber, and combinations and derivatives thereof. It should be understood that the disclosure referring to the steps involving the fluoropolymer seal are also intended to refer to steps involving the non-fluoropolymer seal in certain embodiments, as the methods, additive packages and lubricant compositions described herein may positively impact the compatibility of the non-fluoropolymer seal.

The fluoropolymer seal may be further defined as a component of the internal combustion engine that includes a fluoropolymer sealing element and/or a fluoropolymer sealing material used for engines and engine peripheral devices. Engine and engine peripheral devices that utilize lubricating compositions often comprise a number of fluoropolymer seals between connecting parts. The fluoropolymer seal may be used between such connecting parts to prevent loss of lubrication, to keep outside contaminants such as water, air, and dust from entering the lubricating system, to separate incompatible fluids, and to help maintain hydraulic system pressure. Examples of the fluoropolymer seal include, but are not limited to, fluoropolymer gaskets, shaft seals, valve stem seals, gear shift seals, and diaphragms. Examples of the fluoropolymer seal also include lubricant-exposed engine components coated with the at least one or more fluoropolymer compounds including, but not limited to, Viton® coated Multi-Layer Steel (MLS) gaskets. In one embodiment, the fluoropolymer seal is a head gasket disposed in the internal combustion engine, with at least a portion of the head gasket being coated with a coating including the at least one or more fluoropolymer compound.

The fluoropolymer seal is subject to discoloration and deterioration when used in engines and peripheral engine devices contacted with lubricant compositions that are not fluoropolymer seal compatible. Fluoropolymer seal compatibility may be referred to as an inability of the lubricant composition to deteriorate the fluoropolymer seal. Lubricating compositions that are not fluoropolymer seal compatible may interact with the fluoropolymer seal, causing the fluoropolymer seal to shrink, swell, soften, lose mechanical and/or dimensional integrity, and combinations thereof.

Fluoropolymer seal compatibility can be qualitatively assessed by using tests that measure the effects of the lubricant composition on the fluoropolymer seal. Qualification tests have been established whereby the effect of the lubricant composition on seal-type materials is measured under a particular set of controlled laboratory bench test conditions. Contemporary test methods for evaluating seal compatibility of lubricants and functional fluids include, but are not limited to, a Volkswagen PV 3344 Elastomer Compatibility Test, a ACEA Oil-Elastomer Seal Test (CEC L-39-T-87), a DaimlerChrysler Oil-Elastomer Seal Test (VDA 675301-"Closed Test Cup") and a API $C_{1-4}$ Elastomer test (ASTM 7216). It should be understood that the step of improving the seal compatibility of the lubricant composition includes improving the properties of the lubricant composition as could be discerned from one or more of the following tests:

| Property or Test | ASTM | ISO | DIN |
|---|---|---|---|
| Hardness (Shore A) | D 2240 | 7619 | 53505 |
| Hardness (IRHD) | D 1415 | 48 | 53519 |
| Tensile Strength | D 412 | 37 | 53504 |
| Ultimate Elongation | D 412 | 37 | 53504 |
| Modulus | D 412 | 37 | 53504 |
| Brittleness Point | D 2137 | 812 | 53546 |
| Temperature Retraction | D 1329 | 2921 | N/A |
| Tear Strength | D 624 | 34, 816 | 53507, 53515 |
| Compression Set | D 395 | 815 | 53517 |
| Air Aging | D 573, D 865 | 188 | 53508 |

Lubricant compositions provided for use and used pursuant to this invention may include those that pass a CEC L-39-T96 seal compatibility test. The CEC L-39-T96 test involves keeping a test specimen of the fluoropolymer seal in the lubricant composition at 150° C. The test specimen is then removed and dried and the properties of the test specimen are assessed and compared to a test specimen of the fluoropolymer seal that was not heated in the lubricant composition. The percent change in the one or more properties of the test specimens fluoropolymer seal is assessed to quantify the compatibility of the fluoropolymer seal with the lubricant composition comprising the sulfonate ester. The incorporation of the sulfonate ester into the lubricant composition decreases the tendency of the lubricant composition to degrade the seals versus lubricant compositions which are free of the sulfonate ester.

The pass/fail criteria include a maximum variation of certain characteristics after immersion for 7 days in a fresh amount of the lubricant composition without pre-aging. The maximum variation for each of the one or more properties of the fluoropolymer seal depends on the type of the at least one or more fluoropolymer compounds used in the fluoropolymer seal, the type of engine used, and whether an after-treatment device is utilized.

The characteristics measured before and after immersion included Hardness DIDC (points); Tensile Strength (%); Elongation at Rupture (%); Volume Variation (%). For heavy-duty diesel engines, the pass/fail criteria are presented below in Table 1:

| Heavy-Duty Diesel Engines | |
|---|---|
| Property | Elastomer Type: RE1 |
| Hardness DIDC, points | −1/+5 |
| Tensile Strength, % | −50/+10 |
| Elongation at Rupture, % | −60/+10 |
| Volume Variation, % | −1/+5 |

In these tests, a conventional lubricant composition passes the test if an exposed test specimen, as compared to an unexposed test specimen, exhibits a change in hardness from −1% to +5%; a change in tensile strength from −50% to +10%; a change in elongation at from −60% to +10%; and a variation in volume from −1% to +5%.

When a lubricant composition comprising the sulfonate ester is tested according to a CEC L-39-T96 seal compatibility test for Heavy-Duty Diesel Engines, the change in hardness can range from −1 to 5%, −0.5 to 5%, −0.1 to 5%, 0.5 to 5%, or 1 to 5%; the change in tensile strength can range from −50 to 10%, −45 to 10%, −40 to 10%, or −35 to 10%; the change in elongation at rupture can range from −60 to 10%, −55 to 10%, −50 to 10%, or −45 to 10%; and the change in volume variation can range from −1 to 5%, −0.75 to 5%, −0.5 to 5%, −0.1 to 5%, or 0 to 5%.

When the sulfonate ester is used in the lubricant compositions described, the resulting lubricant composition has a fluoropolymer compatibility such that the tested fluoropolymer seal submerged in the lubricant composition exhibits a change in tensile strength of less than 10, less than 15, less than 20, less than 25, less than 30, less than 35, less than 40, less than 45, less than 50, less than 55, or less than 60, %, when tested according to the CEC L-39-T96 seal compatibility test for Heavy-Duty Diesel Engines. Similarly, when the sulfonate ester is used in the lubricant composition described, the resulting lubricant composition has a fluoropolymer seal compatibility such that the tested fluoropolymer seal exhibits a change in elongation at rupture of less than 20, less than 25, less than 30, less than 35, less than 40, less than 45, less than 50, less than 55, or less than 60, %, when tested according to the CEC L-39-T96 seal compatibility test for Heavy-Duty Diesel Engines.

Some of the compounds described above may interact in the lubricant composition, so that the components of the lubricant composition in final form may be different from those components that are initially added or combined together. Some products formed thereby, including products formed upon employing the lubricant composition of this invention in its intended use, are not easily described or describable. Nevertheless, all such modifications, reaction products, and products formed upon employing the lubricant composition of this invention in its intended use, are expressly contemplated and hereby included herein. Various embodiments of this invention include one or more of the modification, reaction products, and products formed from employing the lubricant composition, as described above.

Furthermore, a method of forming the lubricant composition is provided. The method includes combining the base oil and the sulfonate ester, and, optionally, the amine compound, the dispersant, and/or the anti-wear compound. The amine compound, the dispersant, the anti-wear compound, and/or the sulfonate ester may be incorporated into the base oil in any convenient way. Thus, the sulfonate ester can be added directly to the base oil by dispersing or dissolving it in the base oil at the desired level of concentration. Alternatively, the base oil may be combined directly with the sulfonate ester in conjunction with agitation until the sulfonate ester is provided at the desired level of concentration. Such combining may occur at ambient or lower temperatures, such as 30, 25, 20, 15, 10, or 5, ° C. The method may further include combining the base oil and/or the sulfonate ester with one or more additives, including but not limited to, the amine compound having a total base number of at least 80 mg KOH/g when tested according to ASTM D4739, the amine dispersant, the phosphorous-containing anti-wear compound, and combinations thereof.

EXAMPLES

Without being limited, in the below examples, exemplary lubricant compositions were formulated by blending each of the components together until homogeneity was achieved.

A lubricant concentrate (lubricant concentrate) containing aminic antioxidant, phenolic antioxidant, anti-foam, base oil, pour point depressant, and viscosity modifier was prepared. The lubricant concentrate was combined with various additives and additional base oils to demonstrate the effect of the additives and additional base oils on compatibility with fluoropolymer seals.

More specifically, several reference lubricant compositions were prepared utilizing the lubricant concentrate described above as a base formulation in accordance with Comparative Examples C1-C10. Comparative Example C1 includes additional base oil while Comparative Examples C2-C10 include various additional additives, such as amine-containing compounds, anti-wear compounds, detergents, and combinations thereof, along with the additional base oil. Comparative Examples C1-C10 are representative of various commercial crankcase lubricants, and are used as baselines to demonstrate the effects of the sulfonate ester. Further, Comparative Examples C1-C10 are used as a baseline to demonstrate the effects of the sulfonate ester on the total base number of the lubricant composition and the sulfated ash weight percent in the lubricant composition.

Exemplary lubricant compositions including the sulfonate ester were prepared utilizing Comparative Example C10 described above as a base formulation in accordance with Practical Examples P1-P3. An additional exemplary lubricant composition including the sulfonate ester was prepared utilizing a different additional base oil as compared to the additional base oil utilized in Comparative Example C10.

The sulfonate ester utilized in Practical Examples P1 and P4 was 3,5,5-trimethylhexyl methanesulfonate having a weight average molecular weight of approximately 222. The sulfonate ester utilized in Practical Example P2 was (2,4-dimethyl-5-cotylsulfonyloxy-pentyl) octane-1-sulfonate having a weight average molecular weight of approximately 485. The sulfonate ester utilized in Practical Example P3 was 3,5,5-trimethylhexyl-4-methylbenzenesulfonate having a weight average molecular weight of approximately 298.

The detergent utilized in Comparative Example C7 was a calcium sulfonate neutral detergent having a weight average molecular weight of approximately 1500 and a total base number of 17 mg KOH/g when tested according to ASTM D2896. The detergent utilized in Comparative Example C8 was a calcium sulfonate overbased detergent having a weight average molecular weight of approximately 500 and a total base number of 297 mg KOH/g when tested according to ASTM D2896.

The amine-containing compounds utilized in Practical Examples P1-P4 and Comparative Examples C7-C10 was a non-borated amine dispersant having a weight average molecular weight of approximately 2225 and a total base number of 17.1 mg KOH/g when tested according to ASTM D4739. The amine-containing compound utilized in Comparative Examples C5 and C6 was 2,2,6,6-tetramethyl-4-piperidyl dodecanoate having a weight average molecular weight of approximately 340. The amine-containing compound utilized in Comparative Example C3 and C4 was bis-(2-ethylhexyl)amine having a weight average molecular weight of approximately 242.

The anti-wear compound utilized in Practical Examples P1-P4 and Comparative Examples C2, C4, C6-C8, and C10 was zinc dialkyl dithiophosphate.

The additional base oil used in Practical Examples P1-P3 and Comparative Examples C1-C10 was mineral base oil. The additional base oil used in Practical Example P4 was synthetic base oil.

The formulations for Practical Examples P1-P4 and Comparative Examples C1-C10 are provided below in Tables 1 and 2. Also, results of the tests for the total base number, tested according to the industry-standard ASTM D4739, and the sulfated ash weight percent, tested according to the industry-standard ASTM D874, are provided below in Tables 1 and 2.

TABLE 1

Formulations of Comparative Examples 1-10 (C1-C10)

| | Example # | | | | | | | | | |
|---|---|---|---|---|---|---|---|---|---|---|
| | C1 | C2 | C3 | C4 | C5 | C6 | C7 | C8 | C9 | C10 |
| Lubricant Concentrate (wt. %) | 12.30 | 12.30 | 12.30 | 12.30 | 12.30 | 12.30 | 12.30 | 12.30 | 12.30 | 12.30 |
| Additional Base Oil (wt. %) | 87.70 | 86.57 | 86.63 | 85.50 | 86.20 | 85.07 | 74.58 | 77.37 | 79.70 | 78.57 |
| Sulfonate Ester (wt. %) | 0 | 0 | 0 | 0 | 0 | 0 | 0 | 0 | 0 | 0 |
| Detergent (wt. %) | 0 | 0 | 0 | 0 | 0 | 0 | 3.99 | 1.20 | 0 | 0 |
| Amine-containing Compounds (wt. %) | 0 | 0 | 1.07 | 1.07 | 1.50 | 1.50 | 8.00 | 8.00 | 8.00 | 8.00 |
| Anti-wear Compound (wt. %) | 0 | 1.13 | 0 | 1.13 | 0 | 1.13 | 1.13 | 1.13 | 0 | 1.13 |
| Total Weight (wt. %) | 100 | 100 | 100 | 100 | 100 | 100 | 100 | 100 | 100 | 100 |
| Total Base Number | 0 | 0 | 2.42 | 2.55 | 2.39 | 2.55 | 2.42 | 4.98 | 1.42 | 1.6 |
| Sulfated Ash (wt. %) | 0.27 | 0.27 | 0.12 | 0.27 | 0.25 | 0.32 | 0.50 | 0.64 | 0.37 | 0.27 |

TABLE 2

Formulations of Comparative Example 10 (C10) and Practical Examples 1-4 (P1-P4)

| Example # | C10 | P1 | P2 | P3 | P4 |
|---|---|---|---|---|---|
| Lubricant Concentrate (wt. %) | 12.30 | 12.30 | 12.30 | 12.30 | 12.30 |
| Additional Base Oil (wt. %) | 78.57 | 77.97 | 77.26 | 77.76 | 77.97 |
| Sulfonate Ester (wt. %) | 0 | 0.60 | 1.31 | 0.81 | 0.60 |

TABLE 2-continued

| Formulations of Comparative Example 10 (C10) and Practical Examples 1-4 (P1-P4) | | | | | |
|---|---|---|---|---|---|
| Example # | C10 | P1 | P2 | P3 | P4 |
| Detergent (wt. %) | 0 | 0 | 0 | 0 | 0 |
| Amine-containing Compounds (wt. %) | 8.00 | 8.00 | 8.00 | 8.00 | 8.00 |
| Anti-wear Compound (wt. %) | 1.13 | 1.13 | 1.13 | 1.13 | 1.13 |
| Total Weight (wt. %) | 100 | 100 | 100 | 100 | 100 |
| Total Base Number | 1.6 | 1.63 | 1.6 | 1.65 | 1.63 |
| Sulfated Ash (wt. %) | 0.27 | 0.33 | 0.16 | 0.30 | 0.32 |

The fluoropolymer seal compatibility of the formulations for Practical Examples P1-P4 and Comparative Examples C1-C10 were tested according to the industry-standard CEC L-39-T96 seal compatibility test. The CEC-L-39-T96 seal compatibility test is performed by submitting the seal in the lubricant composition, heating the lubricant composition with the seal contained therein to an elevated temperature, and maintaining the elevated temperature for a period of time. The seals are then removed and dried, and the mechanical properties of the seal are assessed and compared to the seal specimens which were not heated in the lubricant composition. The percent change in these properties is analyzed to assess the compatibility of the seal with the lubricant composition. The results of the compatibility tests are shown below in Tables 3 and 4:

TABLE 3

| Fluoropolymer Seal Compatibility Test Results - Comparative Examples 1-10 (C1-C10) | | | | | | | | | | |
|---|---|---|---|---|---|---|---|---|---|---|
| | Example # | | | | | | | | | |
| | C1 | C2 | C3 | C4 | C5 | C6 | C7 | C8 | C9 | C10 |
| Volume Change (%) | 0.7 | 0.8 | 1.7 | 1.9 | 0.9 | 1.4 | 0.85 | 0.95 | 0.55 | 0.5 |
| Points Hardness DIDC | 0 | 0 | −0.5 | 6.5 | −0.5 | 1 | −0.5 | 2.5 | 3.5 | 2 |
| Tensile Strength (%) | 4.5 | 3 | −31 | −63.5 | −1.5 | −12 | −10 | −29.5 | −26.5 | −24 |
| Elongation at Rupture (%) | 0.5 | 0 | −29.5 | −74.5 | 3 | −32 | −35 | −53 | −43.5 | −41 |

TABLE 4

| Fluoropolymer Seal Compatibility Test Results - Comparative Example 10 (C10) and Practical Examples 1-4 (P1-P4) | | | | | |
|---|---|---|---|---|---|
| Example # | C10 | P1 | P2 | P3 | P4 |
| Volume Change (%) | 0.5 | 1.2 | 3.85 | 1.45 | 0.8 |
| Points Hardness DIDC | 2 | 0 | −1 | −0.5 | 0 |
| Tensile Strength (%) | −24 | −3 | −8 | −5 | 3 |
| Elongation at Rupture (%) | −41 | −17.5 | −11 | −12.5 | 2.5 |

These examples demonstrate that the sulfonate ester improves the compatibility of a lubricant composition with fluoropolymer seals. For example, the examples demonstrate that lubricant compositions that include the sulfonate ester demonstrate improved tensile strength and/or elongation at rupture, even when combined with components that would ordinarily be expected to negatively affect the seal compatibility of the lubricant composition in a significant way. In summary, lubricant compositions that include the sulfonate ester demonstrate superior results when compared to lubricant compositions that do not include the sulfonate ester.

Further, the examples demonstrate that the sulfonate ester in a lubricant composition has a minimal effect on the total base number of the lubricant composition and the sulfated ash weight percent in the lubricant composition.

As described above, the lubricant composition, such as the crankcase lubricant composition, may include one or more of the aforementioned additives, in varying amounts. Representative amounts of certain additives are described below:

| Example # | Range #1 | Range #2 | Range #3 |
|---|---|---|---|
| Sulfonate Ester (wt. %) | 0.1-10 | 0.1-5 | 0.3-2 |
| Amine Compound (wt. %) | 0-10 | 0.1-5 | 0.3-3 |
| Anti-wear Compound (wt. %) | 0-10 | 0.1-5 | 0.3-2 |
| Amine Dispersant (wt. %) | 0-20 | 0.1-15 | 3-15 |
| Antioxidant (wt. %) | 0-10 | 0.1-5 | 0.1-2 |
| Base oil | Balance | Balance | Balance |

It is to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and/or in combination and provides adequate support for specific embodiments within the scope of the appended claims.

It is also to be understood that any ranges and sub-ranges relied upon in describing various embodiments of the present invention independently and collectively fall within the scope of the appended claims and are understood to describe and contemplate all ranges, including whole and/or fractional values therein, even if such values are not expressly written herein. One of skill in the art readily recognizes that the enumerated ranges and sub-ranges sufficiently describe and enable various embodiments of the present invention and such ranges and sub-ranges may be further delineated into relevant halves, thirds, quarters, fifths, and so on. As just one example, a range "ranging from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims and may be relied upon individually and/or collectively and provide adequate support for specific embodiments within the scope of the appended claims.

In addition, with respect to the language which defines or modifies a range, such as "at least," "greater than," "less than," "no more than," and the like, it is to be understood that such language includes sub-ranges and/or an upper or lower limit. As another example, a range of "at least 10" inherently includes a sub-range ranging from at least 10 to 35, a sub-range ranging from at least 10 to 25, a sub-range from 25 to 35, and so on, and each sub-range may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "ranging from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner and it is to be understood that the terminology which has been used is intended to be in the nature of words of description rather than of limitation. Many modifications and variations of the present invention are possible in light of the above teachings and the invention may be practiced otherwise than as specifically described.

The invention claimed is:

1. A lubricant composition having improved compatibility with fluoropolymer seals, said lubricant composition comprising:

a base oil; and a sulfonate ester of a general formula (I):

(I)

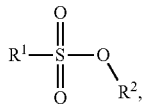

wherein $R^1$ is an alkyl group having from 1 to 17 carbon atoms and $R^2$ is a 3,5,5-trimethylhexyl group.

2. The lubricant composition of claim 1 wherein said sulfonate ester contributes less than 5 mg KOH/g to a total base number of said lubricant composition when tested according to ASTM D4739.

3. The lubricant composition of claim 1 wherein said sulfonate ester contributes less than 0.35 wt. % sulfated ash to said lubricant composition when tested according to ASTM D874.

4. The lubricant composition of claim 1 wherein said sulfonate ester is present in an amount of from 0.1 to 5 wt. % based on the total weight of said lubricant composition.

5. The lubricant composition of claim 1 further comprising an amine compound, said amine compound having a total base number of at least 80 mg KOH/g when tested according to ASTM D4739.

6. The lubricant composition of claim 5 wherein said amine compound is a cyclic amine compound of:

a general formula (V):

(V)

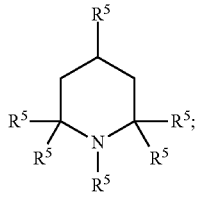

wherein each $R^5$ is independently a hydrogen atom or a hydrocarbyl group having from 1 to 17 carbon atoms; or a general formula (VI):

(VI)

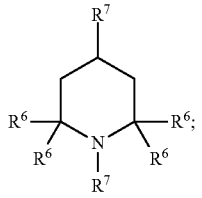

wherein each $R^6$ is independently a hydrogen atom or a hydrocarbyl group having from 1 to 17 carbon atoms;

wherein at least two groups designated by $R^6$ are an alkyl group; and wherein each $R^7$ is independently a hydrogen atom or a hydrocarbyl group having from 1 to 17 carbon atoms.

7. The lubricant composition of claim 6 further comprising a phosphorous-containing anti-wear compound.

8. The lubricant composition of claim 1 wherein said lubricant composition has a fluoropolymer seal compatibility such that a fluoropolymer seal submerged in said lubricant composition exhibits a change in elongation of from −60 to 10% or a change in tensile strength of from −50 to 10%, when tested according to CEC L-39-T96.

9. An additive package for a lubricant composition that provides improved compatibility with fluoropolymer seals, said additive package comprising a sulfonate ester of a general formula (I):

(I)

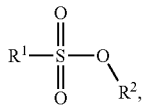

wherein $R^1$ is an alkyl group having from 1 to 17 carbon atoms and $R^2$ is a 3,5,5-trimethylhexyl group.

10. The additive package of claim 9 further comprising an amine compound having a total base number of at least 80 mg KOH/g when tested according to ASTM D4739.

11. The additive package of claim 10 further comprising a phosphorous-containing anti-wear compound.

12. A method of improving compatibility of a lubricant composition with a fluoropolymer seal disposed in an internal combustion engine, wherein the lubricant composition comprises a base oil and a sulfonate ester of a general formula (I):

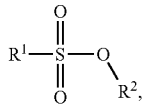

(I)

and wherein $R^1$ is an alkyl group having from 1 to 17 carbon atoms and $R^2$ is a 3,5,5-trimethylhexyl group; said method comprising:

providing the lubricant composition; and contacting the fluoropolymer seal disposed in the internal combustion engine with the lubricant composition.

13. The method of claim 12 further comprising the step of circulating the lubricant composition through the internal combustion engine.

14. The method of claim 12 wherein the fluoropolymer seal is further defined as a head gasket disposed in the internal combustion engine, with the head gasket including a fluoropolymer coating on at least a portion of the head gasket.

15. The method of claim 14 wherein the step of contacting the fluoropolymer seal disposed in the internal combustion engine is further defined as circulating the lubricant composition through the internal combustion engine such that the lubricant composition contacts the fluoropolymer coating of the head gasket.

* * * * *